US011756521B2

(12) United States Patent
Hakuta

(10) Patent No.: US 11,756,521 B2
(45) Date of Patent: Sep. 12, 2023

(54) SOUNDPROOF STRUCTURE AND SOUNDPROOF UNIT

(71) Applicant: FUJIFILM Corporation, Tokyo (JP)

(72) Inventor: Shinya Hakuta, Ashigara-kami-gun (JP)

(73) Assignee: FUJIFILM Corporation, Tokyo (JP)

( * ) Notice: Subject to any disclaimer, the term of this patent is extended or adjusted under 35 U.S.C. 154(b) by 433 days.

(21) Appl. No.: 17/176,272

(22) Filed: Feb. 16, 2021

(65) Prior Publication Data

US 2021/0166671 A1 Jun. 3, 2021

Related U.S. Application Data

(63) Continuation of application No. PCT/JP2019/027646, filed on Jul. 12, 2019.

(30) Foreign Application Priority Data

Aug. 17, 2018 (JP) ..... 2018-153519

(51) Int. Cl.
*G10K 11/172* (2006.01)

(52) U.S. Cl.
CPC ..... *G10K 11/172* (2013.01)

(58) Field of Classification Search
CPC ..... G10K 11/172
See application file for complete search history.

(56) References Cited

U.S. PATENT DOCUMENTS 3,059,564 A * 10/1962 Curran ..... F24F 3/0522 454/262
5,241,512 A * 8/1993 Argy ..... G10K 11/172 181/207

(Continued)

FOREIGN PATENT DOCUMENTS

JP 10-333686 A 12/1998
JP 2000-99034 A 4/2000

(Continued)

OTHER PUBLICATIONS

International Preliminary Report on Patentability (Form PCT/IPEA/409) for International Application No. PCT/JP2019/027646, dated Aug. 5, 2020, with an English translation.

(Continued)

*Primary Examiner* — Forrest M Phillips
(74) *Attorney, Agent, or Firm* — Birch, Stewart, Kolasch & Birch, LLP

(57) ABSTRACT

Provided are a soundproof structure and a soundproof unit that can be reduced in size and thickness in the soundproof structure using Helmholtz resonance. The soundproof structure that includes a housing forming a space therein and having a through hole that allows the space to communicate with an outside, and generates Helmholtz resonance by the space and the through hole, the soundproof structure includes a rear surface plate disposed at a position overlapping the through hole on the space side as viewed from a penetrating direction of the through hole, in which assuming that a diameter of the through hole is Φ and a distance from the rear surface plate to an opening surface of the through hole on the space side is d, d≤Φ is satisfied and d≤6 mm is satisfied.

19 Claims, 18 Drawing Sheets

(56) References Cited

U.S. PATENT DOCUMENTS

| | | | | |
|---|---|---|---|---|
| 6,023,938 | A * | 2/2000 | Taras | F24F 13/082 454/206 |
| 6,104,608 | A * | 8/2000 | Casinelli | F24F 13/24 181/224 |
| 6,606,876 | B1 * | 8/2003 | Giordano | B60H 1/00564 62/244 |
| 6,834,744 | B2 * | 12/2004 | Toki | H04R 1/021 381/345 |
| 7,644,803 | B2 * | 1/2010 | Hashizume | F04D 29/665 181/224 |
| 8,146,707 | B2 * | 4/2012 | Choi | F24F 1/0047 181/198 |
| 10,490,178 | B2 * | 11/2019 | Schnitta | E04B 9/006 |
| 2005/0096882 | A1 * | 5/2005 | Huang | G10K 11/172 702/191 |
| 2008/0247587 | A1 | 10/2008 | Sato | |
| 2015/0101883 | A1 * | 4/2015 | Xu | F24F 13/082 181/224 |
| 2021/0237394 | A1 * | 8/2021 | Huang | B32B 3/20 |

FOREIGN PATENT DOCUMENTS

| | | | |
|---|---|---|---|
| JP | 2004-279779 | A | 10/2004 |
| JP | 2007-47560 | A | 2/2007 |
| JP | 2008-278476 | A | 11/2008 |
| JP | 2010-168748 | A | 8/2010 |
| WO | WO 2004/061817 | A1 | 7/2004 |

OTHER PUBLICATIONS

International Search Report (Form PCT/ISA/210) for International Application No. PCT/JP2019/027646, dated Sep. 3, 2019, with an English translation.

Selamet et al., "Circular concentric Helmholtz resonators," The Journal of the Acoustical Society of America, vol. 101, No. 1, Jan. 1997, pp. 41-51, 11 pages total.

* cited by examiner

SOUNDPROOF STRUCTURE AND SOUNDPROOF UNIT

CROSS-REFERENCE TO RELATED APPLICATIONS

This application is a Continuation of PCT International Application No. PCT/JP2019/027646 filed on Jul. 12, 2019, which claims priority under 35 U.S.C. § 119(a) to Japanese Patent Application No. 2018-153519 filed on Aug. 17, 2018. The above application is hereby expressly incorporated by reference, in its entirety, into the present application.

BACKGROUND OF THE INVENTION

1. Field of the Invention

The present invention relates to a soundproof structure and soundproof unit.

2. Description of the Related Art

Helmholtz resonance is known as a structure having a space inside a container (rear surface volume) and a through hole communicating the space with outside. The following equation for determining a resonance frequency of Helmholtz resonance is also known.

$$\text{Resonance frequency } f=c/2\pi\times\sqrt{(S/(V\times L_1))}$$

c: speed of sound, S: cross-sectional area of through hole, V: internal volume of container, $L_1$: length of through hole+opening end correction distance The mechanism of Helmholtz resonance is resonance in which the thermodynamic adiabatic compression and expansion in the rear surface volume functions as a spring, and an air in the through hole functions as a mass. In an equivalent circuit model, the former is conductance C and the latter is inductance L.

Here, $L_1$ in the above equation is a value obtained by adding the opening end correction distance to the length of the through hole. In the through hole, in addition to the actual length of the through hole, the air around the through hole is affected in a case where sound passes through the through hole, so that a region affected by the through hole is widened outside the through hole, thereby effectively increasing the length of the through hole. This effect is known as opening end correction, and a difference between a measured value $L_0$ of the through hole and an effective length $L_1$ is called the opening end correction distance.

Conventionally, it is known that the opening end correction distance depends on the diameter of the through hole. It is known that the opening end correction distance is 1.2 times to 1.5 times the radius of the through hole, although it depends on the presence or absence of fringes. As an example examined in more detail, J. Acoust. Soc. Am., 101, 41 discloses an equation that depends on the diameter of the through hole and the diameter of the rear surface space.

It is known that such Helmholtz resonance is used for sound absorption.

For example, JP2010-168748A discloses a sound absorbing body having a tubular column shape, a hollow portion between an outer surface and an inner surface of the tubular column shape, and a cyclic opening portion that goes around the inner surface and connects the hollow portion and a space inside the inner surface. The sound absorbing body acts as a Helmholtz resonator due to the mass of the air in the opening portion and the springiness of the air in the hollow portion.

SUMMARY OF THE INVENTION

Space-saving is increasingly required in vehicles and electrical products. In particular, since the soundproof structure utilizing Helmholtz resonance has a structure including a rear surface wall, it is often used as a wall of apparatus, and it is required to make the thickness direction thin.

However, in a case of the soundproof structure using Helmholtz resonance, it is difficult to reduce the rear surface volume since the frequency (resonance frequency) at which sound is reduced depends on the rear surface volume, and in particular, in a case of reducing low frequency sound, it is necessary to increase the rear surface volume, so that it is difficult to reduce the size and thickness.

An object according to an aspect of the present invention is to provide a soundproof structure and a soundproof unit that can be reduced in size and thickness in the soundproof structure using Helmholtz resonance by solving the problems of the prior art.

In order to solve the problem, the present invention has the following configurations.

[1] A soundproof structure that includes a housing forming a space therein and having a through hole that allows the space to communicate with an outside, and generates Helmholtz resonance by the space and the through hole, the soundproof structure comprising:

a rear surface plate disposed at a position overlapping the through hole on the space side as viewed from a penetrating direction of the through hole, in which assuming that a diameter of the through hole is Φ and a distance from the rear surface plate to an opening surface of the through hole on the space side is d, $d\leq\Phi$ is satisfied and $d\leq 6$ mm is satisfied.

[2] The soundproof structure according to [1], in which a part of the housing functions as the rear surface plate.

[3] The soundproof structure according to [1], in which the rear surface plate is disposed in the space.

[4] The soundproof structure according to [3], in which the rear surface plate is movable in the penetrating direction of the through hole.

[5] The soundproof structure according to any one of [1] to [4], in which the through hole has a diameter Φ of 1 mm or more.

[6] The soundproof structure according to any one of [1] to [5], in which a coefficient of an opening end correction in the through hole is 1.8 or more.

[7] The soundproof structure according to any one of [1] to [6], in which at least a part of the housing is formed of a hollow material or a foamed material.

[8] The soundproof structure according to any one of [1] to [7], in which an average thickness of the entire soundproof structure is 10 mm or less.

[9] The soundproof structure according to any one of [1] to [8], further comprising: a porous sound absorbing body attached to at least a part of the soundproof structure.

[10] A soundproof unit comprising: a plurality of the soundproof structures according to any one of [1] to [9].

[11] The soundproof unit according to [10], in which the soundproof unit has two or more soundproof structures having different resonance frequencies.

[12] The soundproof unit according to [10] or [11], in which in the two or more soundproof structures having different resonance frequencies, the through holes have the same diameter and the spaces have different volumes.

[13] The soundproof unit according to [10] or [11], in which in the two or more soundproof structures having different resonance frequencies, the housings have the same shape and the through holes have different diameters.

According to the present invention, it is possible to provide a soundproof structure and a soundproof unit that can be reduced in size and thickness in the soundproof structure using Helmholtz resonance.

BRIEF DESCRIPTION OF THE DRAWINGS

FIG. 12 is a graph showing a relationship between a rear surface distance and an opening end correction coefficient a.

DESCRIPTION OF THE PREFERRED EMBODIMENTS

Figure 1:
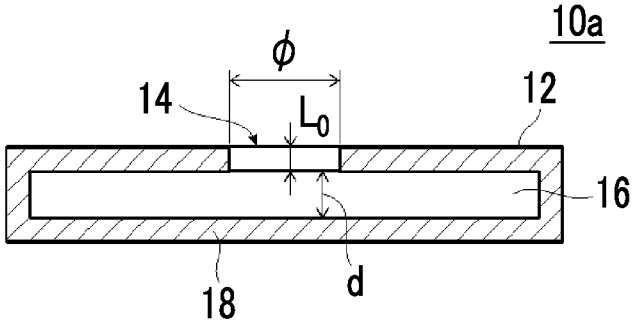
FIG. 1 is a cross-sectional view schematically showing an example of a soundproof structure according to an aspect of the present invention.

Hereinafter, a soundproof structure and a soundproof unit according to an aspect of the present invention will be described in detail.

The description of constituent elements described below may be made on the basis of typical embodiments of the present invention, but the invention is not limited to such embodiments. That is, hereinafter, the soundproof structure according to an aspect of the present invention has been described with various embodiments, but the present invention is not limited to these embodiments, and various modifications or changes may be made without departing from a gist of the present invention.

In the present specification, a numerical range expressed using "to" means a range including numerical values described before and after "to" as a lower limit value and an upper limit value.

Further, in the present specification, for example, angles such as "45°", "parallel", "vertical", and "orthogonal" mean that a difference from an exact angle is within a range of less than 5 degrees, unless otherwise specified. The difference from the exact angle is preferably less than 4 degrees and more preferably less than 3 degrees.

In addition, in the present specification, the "same", "identical", and "match" include an error range generally accepted in the technical field.

In the present specification, "entire part", "all", and "entire surface" may be 100%, and may include an error range generally accepted in the technical field, for example, 99% or more, 95% or more, or 90% or more.

<Soundproof Structure>

The soundproof structure according to an aspect of the present invention is a soundproof structure that includes a housing forming a space therein and having a through hole that allows the space to communicate with an outside, and generates Helmholtz resonance by the space and the through hole, the soundproof structure comprising:

a rear surface plate disposed at a position overlapping the through hole on the space side as viewed from a penetrating direction of the through hole, in which assuming that a diameter of the through hole is Φ and a distance from the rear surface plate to an opening surface of the through hole on the space side is d, d≤Φ is satisfied and d≤6 mm is satisfied.

The soundproof structure and the soundproof unit according to an aspect of the present invention can be suitably used as a sound reduction means for reducing sounds generated by various kinds of electronic apparatuses, transportation apparatuses, and the like.

The electronic apparatus includes household appliance such as an air conditioner, an air conditioner outdoor unit, a water heater, a ventilation fan, a refrigerator, a vacuum cleaner, an air purifier, an electric fan, a dishwasher, a microwave oven, a washing machine, a television, a mobile phone, a smartphone, and a printer; office equipment such as a copier, a projector, a desktop PC (personal computer), a notebook PC, a monitor, and a shredder, computer apparatuses that use high power such as a server and a supercomputer, scientific laboratory equipment such as a constant-temperature tank, an environmental tester, a dryer, an ultrasonic cleaner, a centrifugal separator, a cleaner, a spin coater, a bar coater, and a transporter.

Transportation apparatus includes vehicles, motorcycles, trains, airplanes, ships, bicycles (especially electric bicycles), personal mobility, and the like.

Examples of a moving object include a consumer robot (a cleaning use, a communication use such as a pet use and a guidance use, and a movement assisting use such as an automatic wheelchair) and an industrial robot.

In addition, the structure can also be used for an apparatus set to emit at least one or more specific single frequency sounds as a notification sound or a warning sound in order to send notification or warning to a user. In addition, in a case where the metal body and the machine resonant vibration at a frequency according to the size, as a result, at least one or more single frequency sounds emitted at a relatively large volume cause a problem as noise, but the soundproof structure according to an aspect of the present invention can be applied to such noise.

Further, the soundproof structure according to an aspect of the present invention can also be applied to a room, a factory, a garage, and the like in which the above-described apparatuses are housed.

An example of a sound source of a sound which is to be reduced by the soundproof structure according to an aspect of the present invention is an electronic part or a power electronics device part including an electric control device such as an inverter, a power supply, a booster, a large-capacity condenser, a ceramic condenser, an inductor, a coil, a switching power supply, and a transformer, a rotary part such as an electric motor or a fan, a mechanical part such as a moving mechanism using a gear and an actuator, and a metal body such as a metal rod, which are included in the various apparatus described above.

In a case where the sound source is an electronic part such as an inverter, the sound source generates a sound (switching noise) according to a carrier frequency.

In a case where the sound source is an electric motor, the sound source generates a sound (electromagnetic noise) with a frequency corresponding to a rotation speed.

In a case where the sound source is the metal body, a sound (single frequency noise) in a frequency according to a resonant vibration mode (primary resonance mode) is generated.

That is, each sound source generates a specific frequency sound to the sound source.

The sound source having a specific frequency often has a physical or electrical mechanism that performs oscillation at a specific frequency. For example, rotation speed and its multiples of a rotating system (such as a fan and a motor) are directly emitted as a sound. In addition, a portion receiving an alternating electrical signal of an inverter often oscillates a sound corresponding to an alternating frequency. In addition, in the metal body such as the metal rod, a resonant vibration according to the size of the metal body occurs, and as a result, the single frequency sound is strongly emitted. Therefore, the rotating system, an alternating circuit system, and the metal body is a sound source with a specific frequency of the sound source.

More generally, the following experiment can be performed to determine whether a sound source has a specific frequency.

The sound source is disposed in an anechoic room or a semi-anechoic room, or in a situation surrounded by a sound absorbing body such as urethane. By setting a sound absorbing body in the periphery, the influence of reflection interference of a room or a measurement system is eliminated. Then, the sound source is allowed to generate a sound, and measurement is performed with a microphone from a separated position to acquire frequency information. A distance between the sound source and the microphone can be appropriately selected depending on the size of the measurement system, and it is desirable to perform the measurement at a distance of appropriately 30 cm or more.

In the frequency information of the sound source, a maximum value is referred to as a peak, and a frequency thereof is referred to as a peak frequency. In a case where the maximum value is higher than that of a sound with a peripheral frequency by 3 dB or higher, the sound with the peak frequency can be sufficiently recognized by human beings, and accordingly, it can be referred to as a sound source with a specific frequency. In a case where the maximum value is higher by 5 dB or more, it can be more recognized, and in a case where the maximum value is higher by 10 dB or more, it can be even more recognized. The comparison with the peripheral frequencies is made by evaluating a difference between a minimum value of the nearest frequency at which the frequency is minimum excluding signal noise and fluctuation, and the maximum value.

In addition, in contrast to a white noise and a pink noise that frequently exist as environmental sounds in the natural world, since a sound in which only a specific frequency component sounds strongly is likely to stand out and gives an unpleasant impression, it is important to remove such noise.

In addition, in a case where the sound emitted from the sound source resonates in a housing of various apparatus, a volume of a sound with a resonance frequency or the frequency of an overtone may increase. Alternatively, in a case where the sound emitted from the sound source in a room, a factory, a garage, and the like in which the above-described apparatuses are housed is resonated, the volume of the sound with the resonance frequency or the frequency of the overtone may increase.

In addition, due to resonance occurring due to a space inside a tire and a cavity inside a sport ball, in a case where vibration is applied, a sound corresponding to the cavity resonance or a high-order vibration mode thereof may also greatly oscillate.

In addition, the sound emitted from the sound source has oscillated with a resonance frequency of a mechanical structure of a housing of various apparatus, or a member disposed in the housing, and a volume of a sound with the resonance frequency or a frequency of the overtone thereof may increase. For example, even in a case where the sound source is a fan, a resonance sound may be generated at a rotation speed much higher than the rotation speed of the fan due to the resonance of the mechanical structure.

The soundproof structure according to an aspect of the present invention can be used by directly attaching to a noise-generating electronic part or a motor. In addition, it can be disposed in a ventilation section such as a duct portion and a sleeve and used for sound reduction of a transmitted sound. Further, it can also be attached to the opening portion of a box having an opening (a box or a room containing various electronic apparatus) to be used as a sound reduction structure for noise emitted from the box. Furthermore, it can also be attached to a wall of a room to suppress noise inside the room. It can also be used without limitation thereto.

An example of the soundproof structure according to an aspect of the present invention will be described with reference to FIG. 1.

FIG. 1 is a cross-sectional view schematically showing an example (hereinafter, a soundproof structure 10*a*) of the soundproof structure according to an aspect of the present invention.

As shown in FIG. 1, the soundproof structure 10*a* consists of a housing 12 having a rear surface space 16 formed inside and a through hole 14 communicating the rear surface space 16 with outside. In the soundproof structure 10*a* shown in FIG. 1, a plate-shaped portion of the housing 12 on the surface side where the through hole 14 is formed and a bottom surface portion facing each other across the rear surface space 16 serve also as the rear surface plate 18 of the present invention. Therefore, as viewed from the penetrating direction of the through hole 14 (upper side in the drawing), the rear surface plate 18 exists at a position overlapping the through hole 14 on the rear surface space 16 side.

In the example shown in FIG. 1, the housing 12 has a cylindrical shape and the inside is hollow, and the through hole 14 is formed in the central portion of one end surface to communicate an internal space (rear surface space 16) with an external space.

The soundproof structure 10*a* is a resonance type soundproof structure in which Helmholtz resonance is generated by the rear surface space 16 and the through hole 14.

In the soundproof structure 10*a* according to an aspect of the present invention, the diameter Φ of the through hole 14 and a distance (hereinafter also referred to as a rear surface distance) d from the rear surface plate 18 to the opening surface of the through hole 14 on the rear surface space 16 side satisfy $d \leq \Phi$, and the rear surface distance d satisfies $d \leq 6$ mm.

The present inventors have found that in a case where the distance (the rear surface distance d) from the through hole 14 to the rear surface plate 18 is smaller than the diameter Φ of the through hole 14 and the rear surface distance d is 6 mm or less, there is an effect that the opening end correction distance of the through hole 14 becomes longer than the opening end correction distance in a normal case (for $d > \Phi$).

Here, it is known that a resonance frequency f in Helmholtz resonance is represented by $$f = c/2\pi \times \sqrt{(S/(V \times L_1))},$$

c: speed of sound, S: cross-sectional area of through hole, V: volume of rear surface space, $L_1$: length of through hole+opening end correction distance (effective length of through hole).

Therefore, in the Helmholtz resonance type soundproof structure, in a case where the distance (the rear surface distance d) from the through hole 14 to the rear surface plate 18 is smaller than the diameter Φ of the through hole 14 and the rear surface distance d is 6 mm or less, the effective length $L_1$ of the through hole 14 becomes longer than the case where $d > \Phi$, so that the resonance frequency f becomes lower from the above equation.

That is, since the resonance frequency can be lowered without increasing the rear surface volume by enlarging the housing, the housing (the soundproof structure) can be made smaller than the soundproof structure resonating at the same resonance frequency. In addition, as shown in the example of FIG. 1, in the case of the configuration in which the housing 12 is used as the rear surface plate 18, since the housing 12 is thinned, the soundproof structure can be thinned.

It should be noted that the rear surface distance d is smaller than the diameter Φ of the through hole 14 and the rear surface distance d is 6 mm or less, there is an effect that the opening end correction distance of the through hole 14 becomes longer than the opening end correction distance in a normal case (for $d > \Phi$).

In the example shown in FIG. 1, a part of the housing 12 functions as the rear surface plate 18, but the present invention is not limited thereto.

Figure 2:
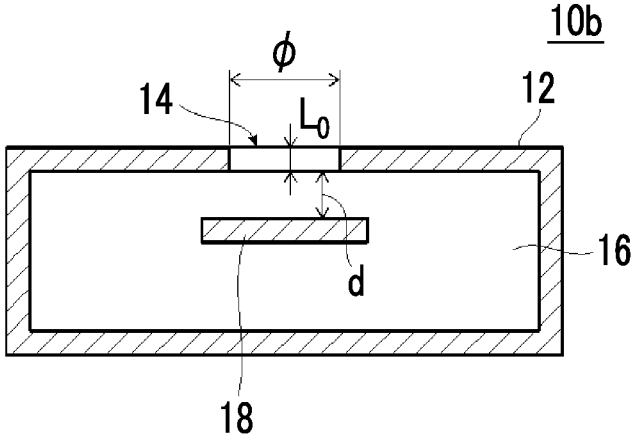
FIG. 2 is a cross-sectional view schematically showing another example of a soundproof structure according to an aspect of the present invention.

FIG. 2 is a cross-sectional view schematically showing another example of the soundproof structure according to an aspect of the present invention.

A soundproof structure 10*b* shown in FIG. 2 has the housing 12 and the rear surface plate 18.

The housing 12 has a cylindrical shape and the inside is hollow, and the through hole 14 is formed in the center portion of one end surface to communicate an internal space (rear surface space 16) with an external space.

The rear surface plate 18 is a plate-shaped member and is disposed in the rear surface space 16. In addition, the rear surface plate 18 is disposed at a position overlapping the through hole 14 as viewed from the penetrating direction (upper side in the drawing) of the through hole 14.

In the soundproof structure 10*b*, the distance (the rear surface distance) d from the rear surface plate 18 to the through hole 14 is equal to or less than the diameter Φ of the through hole 14, and the rear surface distance d is equal to or less than 6 mm.

As described above, even in a case the rear surface plate 18 is configured to be disposed at a position where the rear surface distance d is equal to or less than the diameter Φ of the through hole and equal to or less than 6 mm with the rear surface plate 18 as a separate member from the housing 12, it is possible to obtain an effect that the opening end correction distance of the through hole 14 is longer than the opening end correction distance in a normal case (for d>Φ).

Therefore, the housing (the soundproof structure) can be made smaller than the soundproof structure resonating at the same resonance frequency.

It should be noted that in the present invention, a member closest to the through hole on the rear surface space side in the through hole in the penetrating direction is set to a rear surface plate.

In the examples shown in FIG. 1 and FIG. 2, the outer shape of the housing 12 is a cylindrical shape, but it is not limited to this, and various shapes can be formed, such as a rectangular parallelepiped shape, a cubic shape, a polyhedron shape, a spherical shape, an elliptical sphere shape, and an irregular three-dimensional shape. It should be noted that in the case of the configuration in which the rear surface plate 18 is a part of the housing 12, it is preferable to have a shape in which a planar surface face each other such as a cylindrical shape, a rectangular parallelepiped shape, a cubic shape, a polyhedron shape, or the like from the viewpoint of easily making the distance between the surface on which the through hole 14 is formed and the surface to be the rear surface plate 18 close.

In addition, in the case of the configuration in which the rear surface plate 18 is set to a part of the housing 12, at least a portion to be the rear surface plate 18, that is, a portion overlapping the through hole 14 as viewed from the penetrating direction of the through hole 14, may be formed near the through hole 14.

Figure 3:
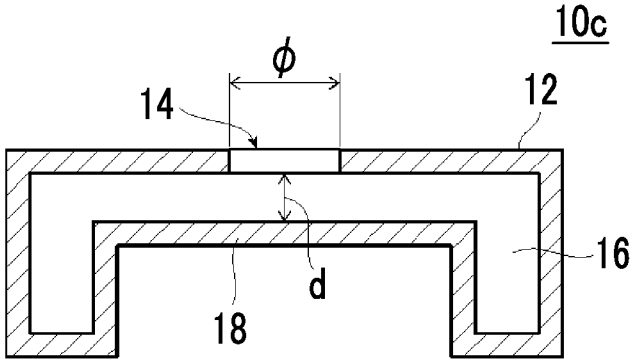
FIG. 3 is a cross-sectional view schematically showing another example of a soundproof structure according to an aspect of the present invention.

For example, in a soundproof structure 10*c* shown in FIG. 3, the shape of the housing 12 (a rear surface space 16) in a cross section parallel to the penetrating direction of the through hole 14 is substantially C-shaped, and the thickness (a thickness in the vertical direction in FIG. 3) of the rear surface space 16 at a position (a center portion in the horizontal direction in FIG. 3) overlapping the through hole 14 as viewed from the penetrating direction of the through hole 14 is thinner than the thickness of the rear surface space 16 at an end portion. By making the shape of the housing 12 such a shape, the rear surface distance d can be set to the diameter Φ or less of the through hole 14.

It should be noted that a ratio d/Φ of the rear surface distance d to the diameter Φ of the through hole 14 is 1 or less, preferably 0.8 or less, more preferably 0.5 or less, and even more preferably 0.4 or less from the viewpoint of making the opening end correction distance longer and making the resonance frequency lower.

The diameter Φ of the through hole 14 is 6 mm or less, preferably 5 mm or less, and more preferably 4 mm or less. By setting the diameter of the through hole 14 to the above range, the thermal viscous friction can be appropriately obtained, and the sound absorbing effect caused by the friction can be largely obtained, so that the soundproof effect can be easily obtained. In a case where the through hole is too large, the sound absorbing effect tends to be small.

In addition, the diameter Φ of the through hole 14 is preferably 1 mm or more, and more preferably 2 mm or more. In a case where the diameter Φ of the through hole 14 is too small, the thermal viscous friction becomes too large, so that the resistance of the through hole increases and sound hardly enters a resonator. Therefore, in a case where the through hole is too small, the effect of the resonator will be small, and therefore the effect of sound absorption and soundproofing becomes smaller. In addition, the larger the diameter Φ of the through hole 14, the larger the opening end correction distance. Therefore, by setting the diameter Φ of the through hole 14 to the above range, sound can surely penetrate into the through hole, and the effect of soundproofing can be suitably obtained. Further, since the opening end correction distance becomes large, the resonance frequency can be shifted to a low frequency.

The length $L_0$ of the through hole 14 is preferably 0.1 mm to 20 mm, more preferably 1 mm to 10 mm, still more preferably 2 mm to 6 mm.

In a case where a through hole is formed in a plate, the length $L_0$ of the through hole 14 is substantially the same as the plate thickness. In a case where the plate thickness is too small, the plate itself tends to vibrate. Since the theory of Helmholtz resonance is constructed on the basis of the fact that the plate on the surface does not vibrate, it becomes difficult to provide soundproofing to the target frequency in a case where the resonance frequency changes due to the vibration.

On the other hand, in a case where the thickness of the plate is too thick, the weight and volume of the structure become large, and it becomes difficult to handle. In addition, since the through hole is long, the thermal viscous friction generated in a case where the hole diameter is the same becomes large. Therefore, the thermal viscous friction tends to be too large, and the sound absorbing effect tends to be small.

Therefore, it is desirable that the length $L_0$ of the through hole 14 is within the above range.

From the viewpoint that the opening end correction distance can be increased, the rear surface distance d is preferably 3 mm or less, and more preferably 2 mm or less.

In addition, from the viewpoint of controlling the Helmholtz resonance frequency not to become too high by keeping the rear surface volume to some extent large, and from the viewpoint of stably manufacturing the rear surface volume substantially the same in a case where a large number of resonators are manufactured, the rear surface distance d is preferably 0.1 mm or more, and more preferably 0.3 mm or more.

In a case where the rear surface distance is too small, the rear surface volume is greatly affected by the deviation between the samples in the manufacture of the resonator and blurring of the thickness in a case where a gluing agent or an adhesive is used. Therefore, it is desirable to set the rear surface distance within the above range.

The opening shape of the through hole 14 is not particularly limited, and may have various shapes such as a circular shape, a square shape, a rectangular shape, a polygonal shape, an elliptical shape, an annular shape, and an irregular shape. In a case where the opening shape of the through hole 14 is other than circular, the equivalent circle diameter is defined as the diameter Φ of the through hole.

In the examples shown in FIG. 1 and FIG. 2, the structure has one through hole, but the present invention is not limited thereto, and the structure may have two or more through holes.

Figure 4:
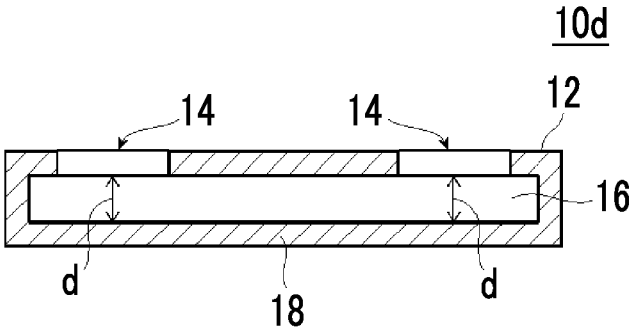
FIG. 4 is a cross-sectional view schematically showing another example of a soundproof structure according to an aspect of the present invention.

For example, a soundproof structure 10*d* shown in FIG. 4 is the soundproof structure having the thin housing 12 in which a part of the housing 12 serves as the rear surface plate 18, and two through hole 14 are formed in one surface.

Figure 5:
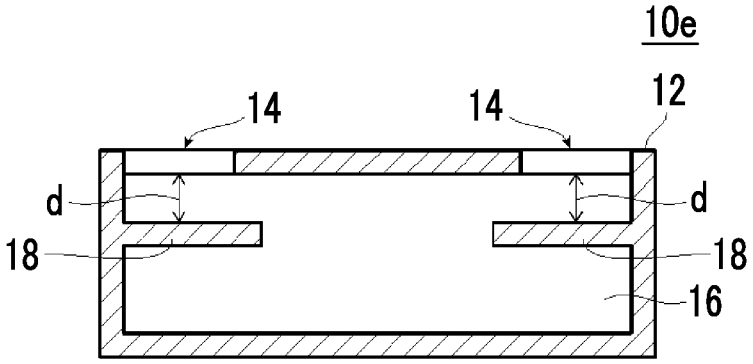
FIG. 5 is a cross-sectional view schematically showing another example of a soundproof structure according to an aspect of the present invention.

A soundproof structure 10*e* shown in FIG. 5 is the soundproof structure in which the rear surface plate 18 is disposed in the rear surface space 16, and two through holes 14 are formed in one surface, and two rear surface plates 18 are disposed in the rear surface space 16 corresponding to the two through holes 14 respectively.

As in the example shown in FIG. 4 to FIG. 5, in the case of the configuration having two or more through holes 14, the opening area of each through hole 14 may be the same or different. In addition, the rear surface distance d corresponding to each through hole 14 may be the same or different.

In the case of the configuration having two or more through holes 14, the equivalent circle diameter may be obtained from the total area of the opening surfaces of all the through holes 14. Further, the rear surface distance d may be obtained by weighting and averaging the rear surface distance d corresponding to each through hole 14 on the basis of the opening area of each through hole 14.

In addition, in the case of a configuration having two or more through holes, each through hole may be formed on a different surface of the housing.

Figure 6:
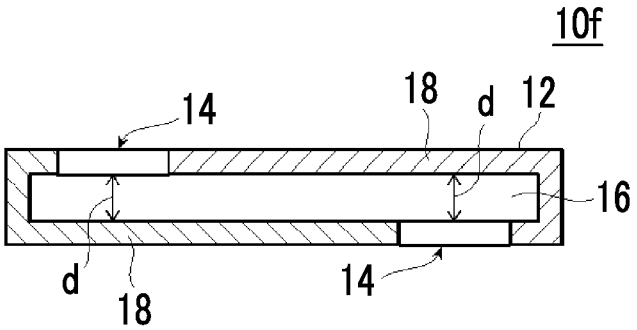
FIG. 6 is a cross-sectional view schematically showing another example of a soundproof structure according to an aspect of the present invention.

For example, a soundproof structure 10*f* shown in FIG. 6 is the soundproof structure having the thin housing 12 in which a part of the housing 12 serves as the rear surface plate 18, and one through hole 14 is formed on one surface and another through hole 14 is formed on the other surface. The two through holes 14 are formed at positions that do not overlap as viewed from the through hole 14 in the penetrating direction. That is, a part of the surface where one through hole 14 is formed functions as the rear surface plate 18 for the other through hole 14, and a part of the surface where the other through hole 14 is formed functions as the rear surface plate 18 for the one through hole 14.

It should be noted that even in the case of the configuration in which two or more through holes are formed on different surfaces, the diameter Φ of the through hole may be an equivalent circle diameter obtained from the total area of the opening surfaces of all the through holes 14. In addition, the rear surface distance d may also be obtained by weighting and averaging the rear surface distance d corresponding to each through hole 14 on the basis of the opening area of each through hole 14.

In the case where the rear surface plate 18 is disposed in the rear surface space 16, the rear surface plate 18 may be movable in the penetrating direction of the through hole 14 in the rear surface space 16. By making the rear surface plate 18 movable, the resonance frequency of the soundproof structure can be adjusted according to the frequency of the noise to be reduced.

The unit for moving the rear surface plate 18 is not particularly limited, and the rear surface plate 18 may be detachably attached in the housing 12, the rear surface plate 18 may be attached at one of a plurality of mounting positions, the rear surface plate 18 may be moved from the outside along a guide groove provided in the housing 12, or the rear surface plate 18 may be moved by an actuator such as an electric motor.

In a case where the rear surface plate 18 is disposed in the rear surface space 16, the rear surface plate 18 may be a flat plate or a curved plate-shaped member.

The soundproof structure according to an aspect of the present invention may have a porous sound absorbing body attached to at least a part of the soundproof structure.

Figure 7:
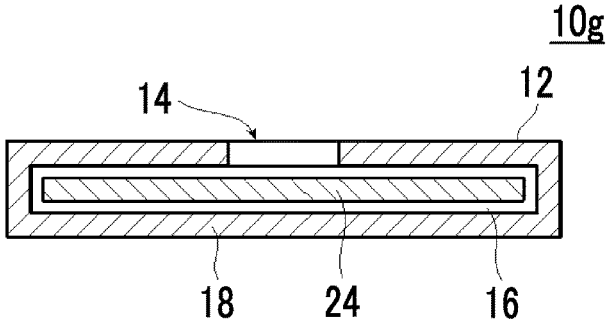
FIG. 7 is a cross-sectional view schematically showing another example of a soundproof structure according to an aspect of the present invention.
Figure 8:
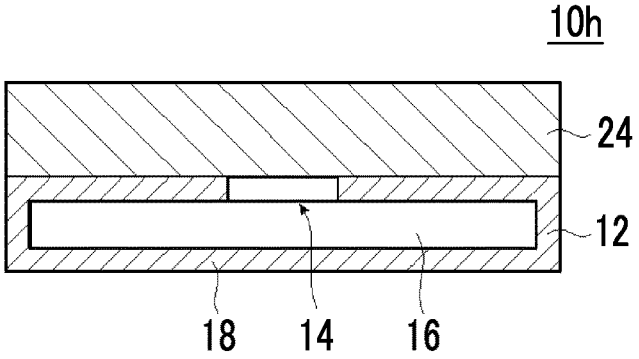
FIG. 8 is a cross-sectional view schematically showing another example of a soundproof structure according to an aspect of the present invention.

For example, a porous sound absorbing body 24 may be provided in the rear surface space 16 as in a soundproof structure 10*g* shown in FIG. 7. Alternatively, as in a soundproof structure 10*h* shown in FIG. 8, the porous sound absorbing body 24 may be disposed in contact with the surface on which the through hole 14 is formed.

By having the porous sound absorbing body, instead of reducing the sound absorption coefficient at a sound absorption peak, it is possible to widen the band.

The porous sound absorbing body is not particularly limited, and a well-known porous sound absorbing body can be suitably used. Examples thereof include various well-known porous sound absorbing bodies such as a foamed material such as urethane foam, soft urethane foam, wood, a ceramic particle sintered material, or phenol foam, and a material containing minute air; a fiber such as glass wool, rock wool, microfiber (such as THINSULATE manufactured by 3M), a floor mat, a carpet, a melt blown nonwoven, a metal nonwoven fabric, a polyester nonwoven, metal wool, felts, an insulation board, and glass nonwoven, and nonwoven materials, a wood wool cement board, a nanofiber material such as a silica nanofiber, and a gypsum board.

In addition, a flow resistance al of the porous sound absorbing body is not particularly limited, and is preferably 1,000 to 100,000 (Pa·s/m$^2$), more preferably 5,000 to 80,000 (Pa·s/m$^2$), and even more preferably 10,000 to 50,000 (Pa·s/m$^2$).

The flow resistance of the porous sound absorbing body can be evaluated by measuring the normal incidence sound absorption coefficient of a porous sound absorbing body having a thickness of 1 cm and fitting the Miki model (J. Acoustic. Soc. Jpn., 11(1) pp. 19-24 (1990)). Alternatively, the evaluation may be performed according to "ISO 9053".

Further, a plurality of porous sound absorbing bodies having different flow resistances may be laminated.

In addition, a plurality of soundproof structures according to an aspect of the present invention may be combined and used as a soundproof unit.

In a case where a plurality of soundproof structures are combined, a configuration having two or more types of soundproof structures having different resonance frequencies may be used. This makes it possible to reduce sounds of a plurality of frequencies.

The configuration in which the resonance frequencies of the plurality of soundproof structures are different is not particularly limited.

Figure 9:
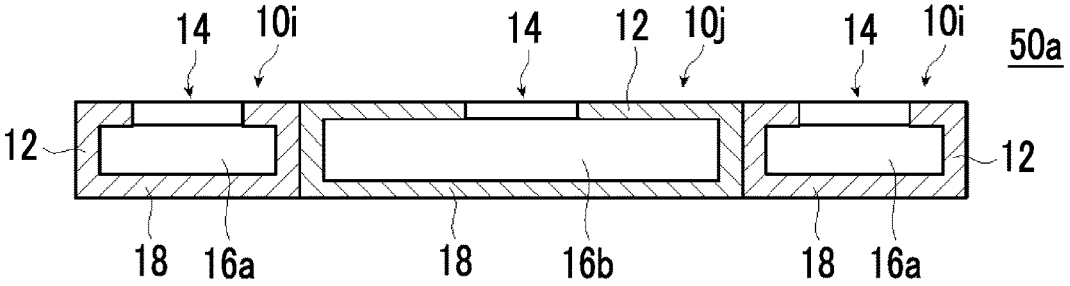
FIG. 9 is a cross-sectional view schematically showing an example of a soundproof unit according to an aspect of the present invention.

For example, the soundproof unit 50*a* shown in FIG. 9 has two types of soundproof structures 10*i* and 10*j* having different resonance frequencies. The soundproof structures 10*i* and 10*j* are thin soundproof structures in which the housing 12 also serves as the rear surface plate 18.

The soundproof structure 10*i* and the soundproof structure 10*j* have the same diameter Φ and rear surface distance d of the through hole 14, but the volumes of the rear surface space 16*a* of the soundproof structure 10*i* and the rear surface space 16*b* of the soundproof structure 10*j* are different. As a result, the resonance frequencies of the soundproof structure 10*i* and the soundproof structure 10*j* are different.

Figure 10:
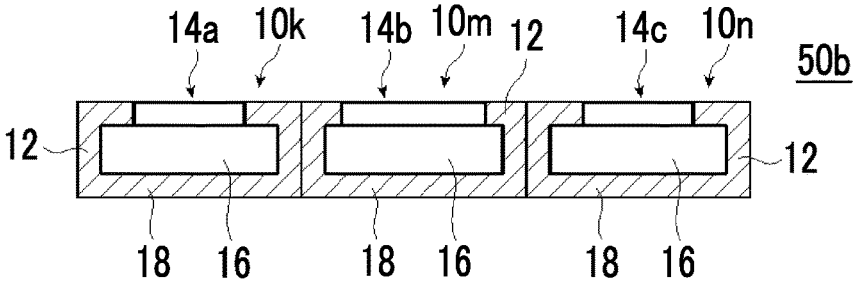
FIG. 10 is a cross-sectional view schematically showing another example of a soundproof unit according to an aspect of the present invention.

In addition, the soundproof unit 50*b* shown in FIG. 10 has three types of soundproof structures 10*k*, 10*m*, and 10*n* having different resonance frequencies. The soundproof structures 10*k*, 10*m*, and 10*n* are thin soundproof structures in which the housing 12 also serves as the rear surface plate 18.

The soundproof structures 10*k*, 10*m*, and 10*n* have the same rear surface distance d and the same volume of the rear surface space 16, but the through hole 14*a* of the soundproof structure 10*k*, the through hole 14*b* of the soundproof structure 10*m*, and the through hole 14*c* of the soundproof structure 10*n* have different diameters. As a result, the resonance frequencies of the soundproof structure 10*k*, the soundproof structure 10*m*, and the soundproof structure 10*n* are different.

It should be noted that the method of making the resonance frequencies of the soundproof structure different is not limited to the above, and may be a configuration in which the rear surface distance is made different, or a plurality of configurations may be made different among the volume of the rear surface space, the diameter of the through hole, the rear surface distance, and the like.

Also, from the viewpoint of obtaining the sound absorbing effect in the audible range, the resonance frequency of the Helmholtz resonance of the soundproof structure is preferably 20,000 Hz or less, more preferably 50 Hz to 20,000 Hz, still more preferably 100 Hz to 15,000 Hz, even more preferably 100 Hz to 12,000 Hz, and particularly preferably 100 Hz to 10,000 Hz.

In the present invention, the audible range is from 20 Hz to 20,000 Hz.

The thickness of the wall surface of the housing 12 is preferably 0.1 mm to 20 mm, more preferably 1.0 mm to 10 mm, and still more preferably 2.0 mm to 6.0 mm. It should be noted that the thickness of the wall surface of the housing 12 may be uniform, or may differ depending on the position. For example, the thickness of the portion where the through hole 14 is formed may be increased according to the length $L_0$ of the through hole.

From the viewpoint of miniaturization of the device, the total thickness (length from one end to the other end of the soundproof structure 10 in the penetrating direction of the through hole 14) of the soundproof structure 10 is preferably 10 mm or less, more preferably 8 mm or less, and still more preferably 5 mm or less.

It should be noted that a lower limit value of the thickness of the soundproof structure 10 is not particularly limited, but is preferably 0.1 mm or more, and more preferably 0.3 mm or more.

[Material of Housing and Rear Surface Plate]

The materials (hereinafter referred to as a housing material) of the housing and the rear surface plate can include metal materials, resin materials, reinforced plastic materials, carbon fibers, and the like. Examples of the metal material include metal materials such as aluminum, titanium, magnesium, tungsten, iron, steel, chromium, chromium molybdenum, nichrome molybdenum, copper, and alloys thereof. Examples of the resin material include resin materials such as an acrylic resin, polymethyl methacrylate, polycarbonate, polyamideide, polyarylate, polyetherimide, polyacetal, polyetheretherketone, polyphenylenesulfide, polysulfone, polyethylene terephthalate, polybutylene terephthalate, polyimide, an ABS resin (acrylonitrile-butadiene-styrene copolymerized synthetic resin), polypropylene, and triacetyl cellulose. Examples of the reinforced plastic material include carbon fiber reinforced plastics (CFRP) and glass fiber reinforced plastics (GFRP).

In addition, various honeycomb core materials can be used as the housing material. Since the honeycomb core material is used as a lightweight and high stiffness material, ready-made products are easily available. The honeycomb core material formed of various materials such as an aluminum honeycomb core, an FRP honeycomb core, a paper honeycomb core (manufactured by Shin Nippon Feather Core Co., Ltd. and Showa Aircraft Industry Co., Ltd.), a thermoplastic resin (a polypropylene (PP), a polyethylene terephthalate (PET), a polyethylene (PE), a polycarbonate (PC), and the like), and a honeycomb core (TECCELL manufactured by Gifu Plastics Industry Co., Ltd.) can be used as the frame material.

In addition, a structure containing air, that is, a foamed material, a hollow material, a porous material, or the like can also be used as the housing material. In order to prevent the air flow between cells in a case of using a large number of soundproof structures, a housing can be formed using, for example, a closed-cell foamed material. For example, various materials such as closed-cell polyurethane, closed-cell polystyrene, closed-cell polypropylene, closed-cell polyethylene, and closed-cell rubber sponge can be selected. The use of closed-cell foam body is suitably used as the housing material, since it prevents a flow of sound, water, gas, and the like and has a high structural intensity, compared to an open-cell foam body. In addition, in a case where the above-described porous sound absorbing body has sufficient supporting properties, the housing may be formed only of the porous sound absorbing body, or the materials described as the materials of the porous sound absorbing body and the housing may be combined by, for example, mixing, kneading, or the like. As described above, the weight of the device can be reduced by using a material system containing air inside. In addition, heat insulation can be provided.

The housing material is preferably a material having higher heat resistance than the flame-retardant material because the soundproof structure 10 can be disposed in a place where the temperature becomes high. The heat resistance can be defined, for example, by a time to satisfy Article 108-2 of the Building Standard Law Enforcement Order. In a case where the time to satisfy Article 108-2 of the Building Standard Law Enforcement Order is 5 minutes or longer and shorter than 10 minutes, it is defined as a flame-retardant material, in a case where the time is 10 minutes or longer and shorter than 20 minutes, it is defined as a quasi-noncombustible material, and in a case where the time is 20 minutes or longer, it is defined as a noncombustible material. However, the heat resistance is often defined for each application field. Therefore, in accordance with the field in which the soundproof structure is used, the housing material may consist of a material having heat resistance equivalent to or higher than flame retardance defined in the field.

In addition, a mesh member having a mesh of a size that does not allow dust to pass therethrough may be disposed in a portion of the through hole 14. As the mesh member, a metal or plastic mesh, a nonwoven fabric, urethane, aerogel, a porous film, or the like can be used.

Next, the effect that in a case where the distance (the rear surface distance d) from the through hole 14 to the rear surface plate 18 is smaller than the diameter Φ of the through hole 14 and the rear surface distance d is 6 mm or less, there is an effect that the opening end correction distance of the through hole 14 becomes longer than the opening end correction distance in a normal case (for d>Φ) will be described using the result of simulation.

A simulation is performed using an acoustic module of the finite element method calculation software COMSOL Multi Physics ver. 5.3 (COMSOL Inc.). The calculation model is a two-dimensional axially symmetric structure calculation model.

<Simulation 1>

The outer shape of the housing is cylindrical shape, and the housing is treated as a rigid body. First, in order to see the influence of opening end correction, the thickness of the wall surface of the housing is set to 20 μm. That is, the length $L_0$ of the through hole is set to 20 μm, which is substantially can be ignored.

A simulation is performed with the diameter Φ of the through hole being 2 mm, 3 mm, and 4 mm, respectively.

The case where the rear surface distance d is 3 mm and the diameter of the rear surface space is 15 mm is used as a reference. The volume of the rear surface space at this time is 530 $mm^3$.

The resonance frequency is obtained by the simulation while keeping the volume of the rear surface space constant and changing the rear surface distance d from 0.5 mm to 4 mm at intervals of 0.5 mm.

Figure 11:
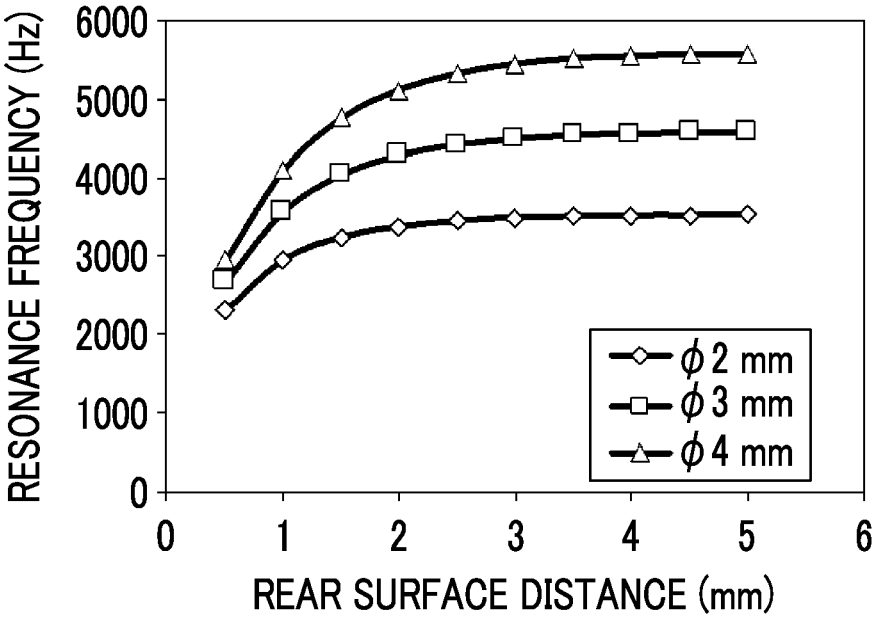
FIG. 11 is a graph showing a relationship between a rear surface distance and a resonance frequency.

The results are shown in FIG. 11. FIG. 11 is a graph showing the relationship between the rear surface distance d and the resonance frequency at each through hole diameter Φ.

From FIG. 11, it can be seen that the resonance frequency shifts to the low frequency side as the rear surface distance d becomes smaller, although the volume of the rear surface space and the diameter Φ of the through hole are the same for any diameter Φ. Further, it can be seen that the resonance frequency is lowered in a case where the rear surface distance d is equal to or less than the diameter Φ of the through hole.

Figure 12:
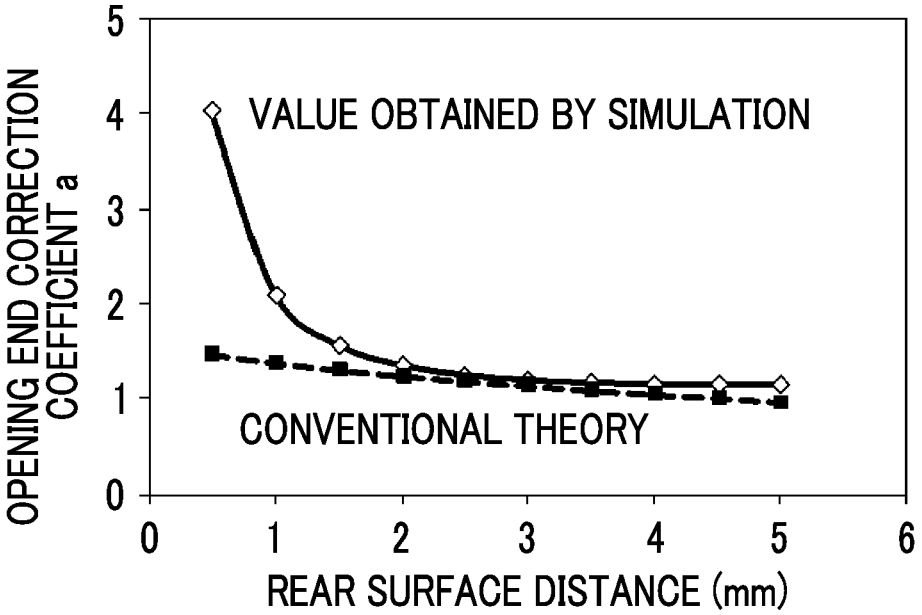

FIG. 12 shows an opening end correction coefficient a obtained from the resonance frequency in a case where the diameter Φ of the through hole is 4 mm. The opening end correction coefficient a is a coefficient a represented by the equation $L_1=L_0+a\times(\Phi/2)$, which represents an effective length $L_1$ obtained by adding the opening end correction distance to the length of the through hole in a case where the actually measured length of the through hole is denoted by $L_0$ and the diameter of the through hole is denoted by Φ.

Since $L_0\approx 0$ in this simulation, $L_1\approx a\times(\Phi/2)$.

In addition, the opening end correction coefficient of the equation shown in J. Acoust. Soc. Am., 101, 41 is shown as a conventional theory.

$$\delta \approx 0.85\left(\frac{d_c}{2}\right)\left(1-1.25\frac{d_c}{d_v}\right)$$

In the equation, $d_c$ is the diameter of the through hole and $d_v$ is the diameter of the rear surface space.

This conventional theory is often established in a case where the diameter Φ of the through hole/the diameter of the rear surface space is smaller than 0.4. In the above setting range, the smaller the rear surface distance d, the larger the diameter of the rear surface space, so that the range is sufficiently established. However, from FIG. 12, it can be seen that in a case where the rear surface distance d is small, the opening end correction coefficient is significantly different from the conventional theory and the value becomes large. The present inventors have found that a large opening end correction coefficient has the effect of making the effective length of the through hole longer than the conventional theory. In the conventional theory, the opening end correction is about 1.7 at the maximum, but in the configuration of the present invention, the extremely large opening end correction coefficient a can be obtained as compared with the conventional theory. That is, in the present invention, the opening end correction coefficient can be set to 1.8 or more.

Figure 13:
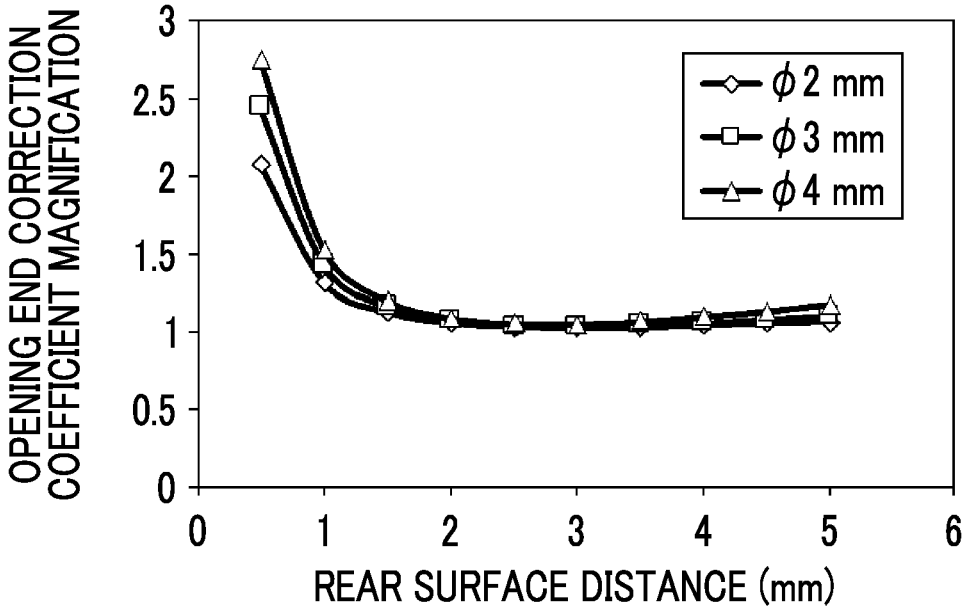
FIG. 13 is a graph showing a relationship between a rear surface distance and a correction coefficient magnification.

FIG. 13 shows a magnification (hereinafter referred to as correction coefficient magnification) between the opening end correction coefficient a obtained from the above simulation and the opening end correction coefficient according to the conventional theory in a case where the diameter Φ of the through hole is 2 mm, 3 mm, and 4 mm, respectively. It is also found that the coefficient tends to be larger than the conventional theory in a case where the rear surface distance becomes smaller, and that the correction coefficient magnification becomes larger as the diameter Φ of the through hole is larger.

<Simulation 2>

Next, a comparison is made in a case where the volume of the rear surface space is changed. The diameters of the rear surface space are set to 15 mm, 20 mm, 25 mm, and 30 mm on the basis of the rear surface distance d=3 mm. That is, the volumes of the rear surface space are 530 $mm^3$, 942 $mm^3$, 1,473 $mm^3$, and 2,121 $mm^3$, respectively.

The diameter Φ of the through hole is set to 2 mm, a simulation is performed by keeping the volume of the rear surface space constant and changing the rear surface distance d from 0.5 mm to 3 mm at intervals of 0.5 mm, and the resonance frequency is obtained. Then, the opening end correction coefficient a is obtained from the resonance frequency, and the correction coefficient magnification is obtained.

Figure 14:
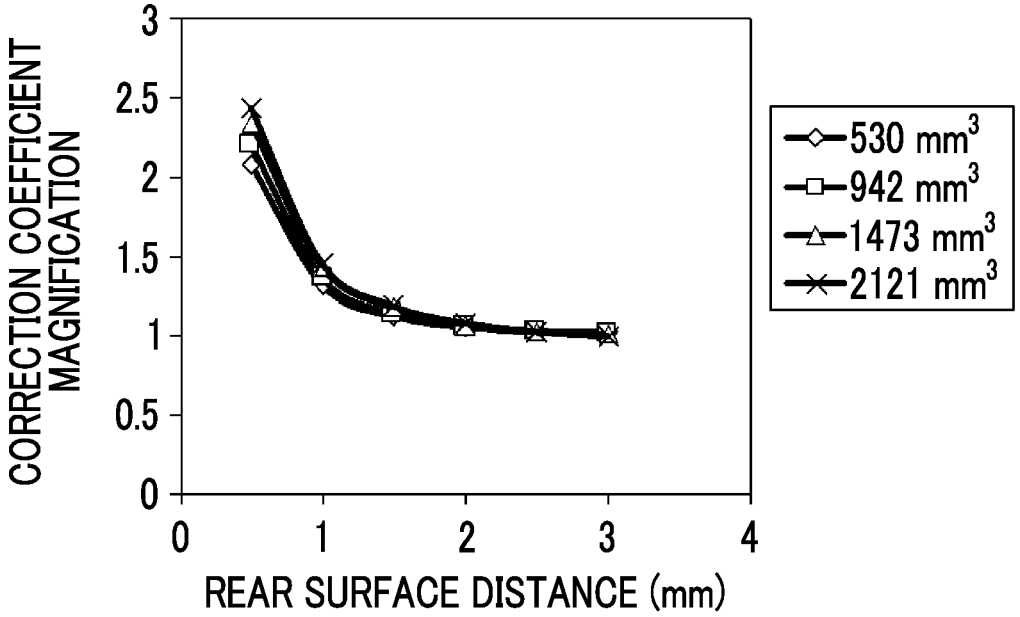
FIG. 14 is a graph showing a relationship between a rear surface distance and a correction coefficient magnification.

The results thereof are shown in FIG. 14.

The correction coefficient magnification is obtained in the same manner as described above except that the diameter Φ of the through hole is set to 4 mm.

Figure 15:
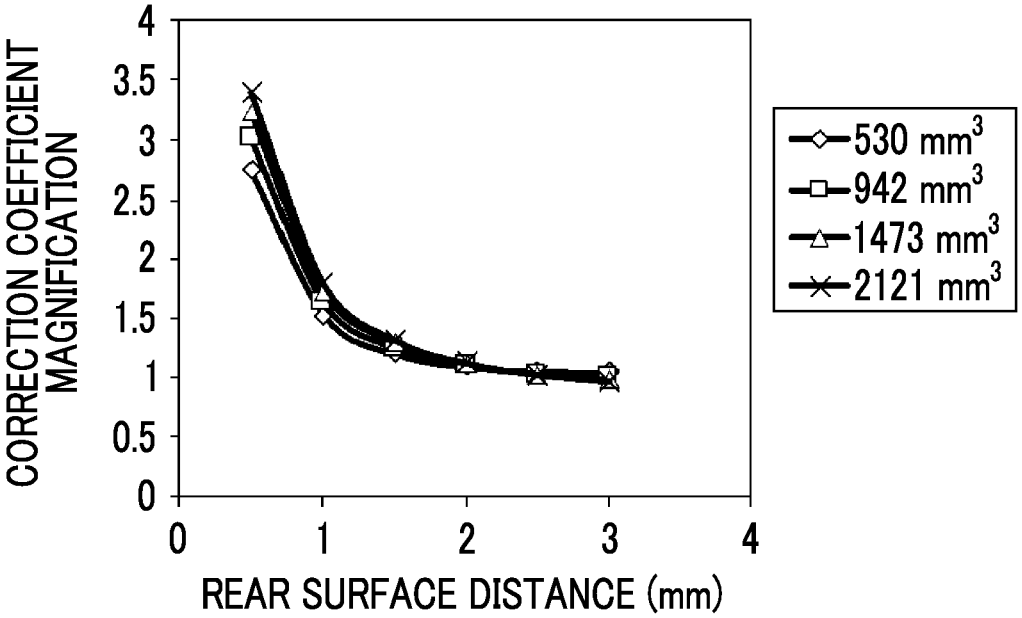
FIG. 15 is a graph showing a relationship between a rear surface distance and a correction coefficient magnification.

The results thereof are shown in FIG. 15.

From FIG. 14 and FIG. 15, even though the diameter Φ of the through hole is 2 mm or 4 mm, and the volume of the rear surface space is different, it can be seen that the behavior of the correction coefficient magnification shows the same behavior. Among them, it is found that the larger the volume of the rear surface space, the larger the correction coefficient magnification tends to be.

Figure 16:
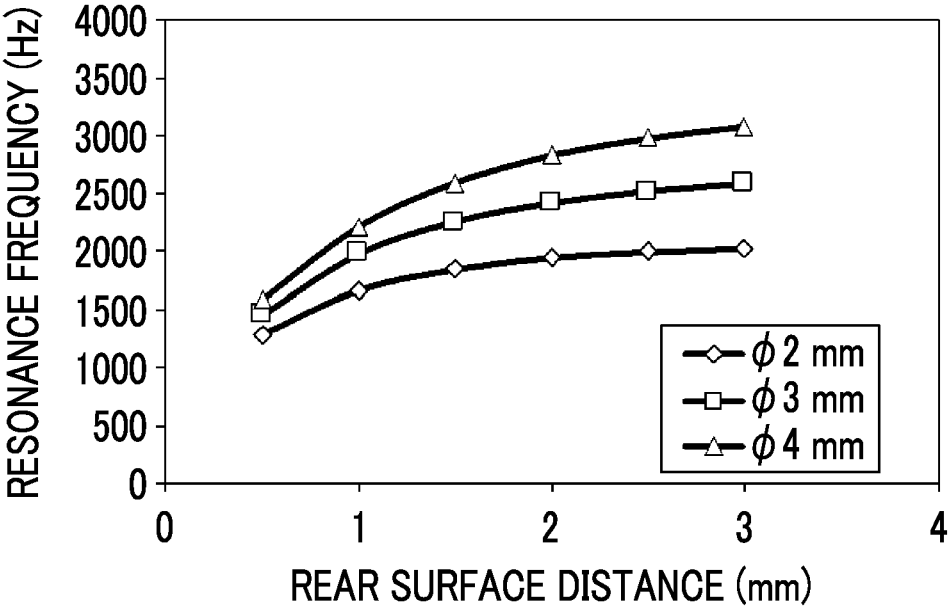
FIG. 16 is a graph showing a relationship between a rear surface distance and a resonance frequency.

FIG. 16 shows the relationship between the rear surface distance d and the resonance frequency in a case where the volume of the rear surface space is 1,473 $mm^3$. The diameter Φ of the through hole is 2 mm, 3 mm, and 4 mm, respectively.

Figure 17:
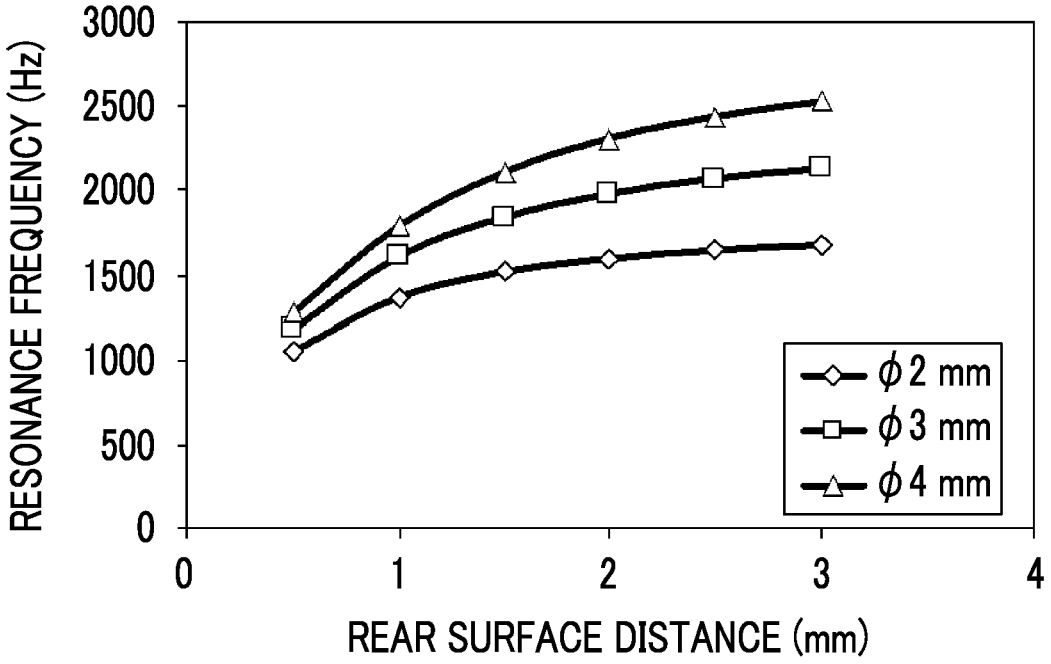
FIG. 17 is a graph showing a relationship between a rear surface distance and a resonance frequency.

Similarly, FIG. 17 shows the relationship between the rear surface distance d and the resonance frequency in a case where the volume of the rear surface space is 2,121 $mm^3$. The diameter Φ of the through hole is 2 mm, 3 mm, and 4 mm, respectively.

Comparing FIGS. 11, 16, and 17, the frequency bands are different, but it can be seen that the resonance frequency shifts to the low frequency side as the rear surface distance d becomes smaller, even in a case where the volume of the rear surface space is constant.

<Simulation 3>

Next, the influence of the through hole length $L_0$ is examined by simulation.

In the same manner as in simulation 1, except that the diameter Φ of the through hole is set to 4 mm, the volume of the rear surface space is 530 $mm^3$, and the length $L_0$ of the through hole is changed from 1 mm to 5 mm at intervals of 1 mm, the resonance frequency is obtained by the simulation with the rear surface distance d varied from 0.5 mm to 4 mm at intervals of 0.5 mm.

Figure 18:
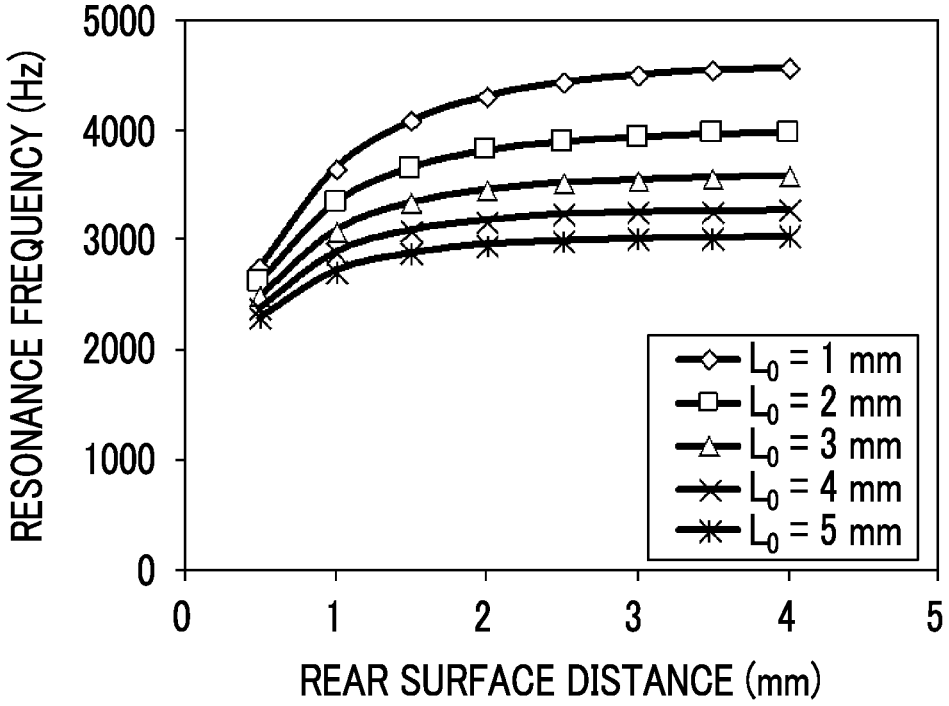
FIG. 18 is a graph showing a relationship between a rear surface distance and a resonance frequency.

The results thereof are shown in FIG. 18. FIG. 18 is a graph which shows the relationship between the rear surface distance d and the resonance frequency at the length $L_0$ of each through hole.

From FIG. 18, it can be seen that the resonance frequency becomes lower as the rear surface distance d becomes smaller regardless of the length $L_0$ of through hole.

Figure 19:
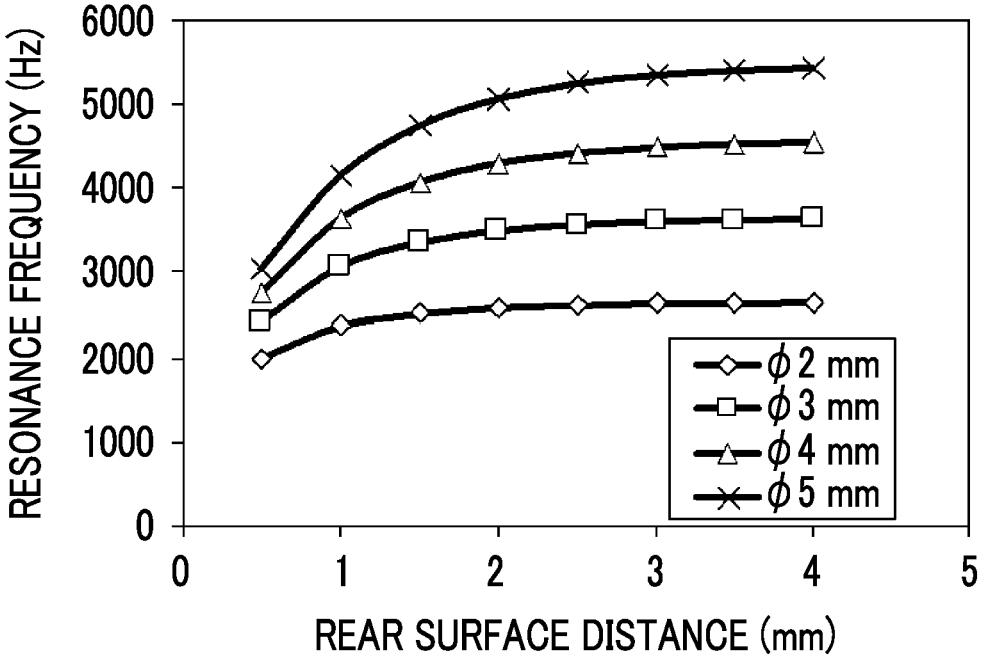
FIG. 19 is a graph showing a relationship between a rear surface distance and a resonance frequency.

FIG. 19 shows the result of obtaining the resonance frequency by performing a simulation in which the length $L_0$ of the through hole is set to 1 mm, the diameter Φ of the through hole is changed from 2 mm to 5 mm at intervals of 1 mm, and the rear surface distance d is changed from 0.5 mm to 4 mm at intervals of 0.5 mm.

From FIG. 19, it can be seen that the resonance frequency becomes lower as the rear surface distance d becomes smaller in each case. At that time, it can be seen that the larger the diameter Φ of the through hole, the lower the frequency starts in the region where the rear surface distance d is large. Specifically, the frequency is lowered when the rear surface distance d is equal to or less than the diameter Φ of the through hole.

In addition, from the relationship between the rear surface distance d and the resonance frequency obtained in FIG. 18 and FIG. 19, the magnification (correction coefficient magnification) of the opening end correction coefficient a to the opening end correction coefficient according to the conventional theory is obtained in the same manner as in the simulation 1.

Figure 20:
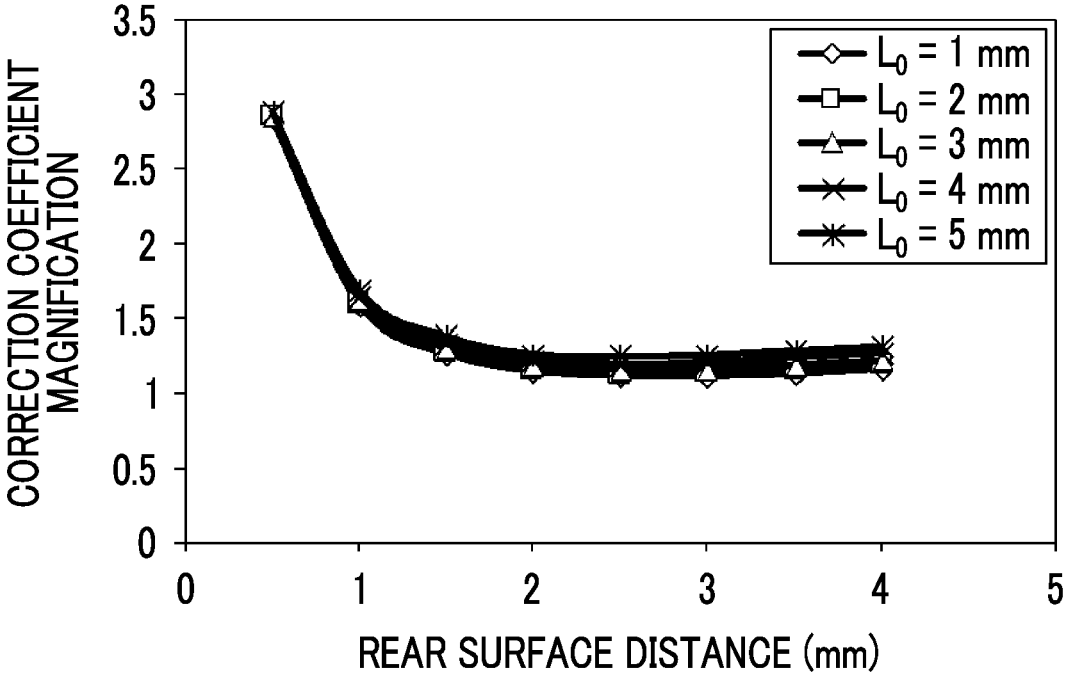
FIG. 20 is a graph showing a relationship between a rear surface distance and a correction coefficient magnification.
Figure 21:
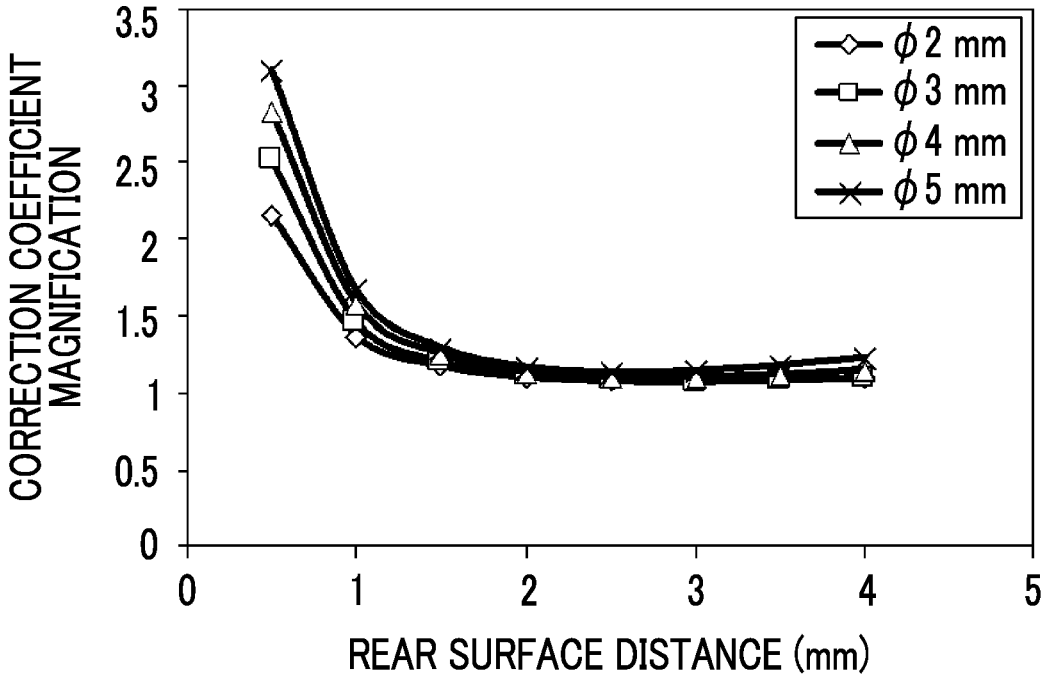
FIG. 21 is a graph showing a relationship between a rear surface distance and a correction coefficient magnification.

FIG. 20 shows the result in a case where the diameter Φ of the through hole is set to 4 mm and the length $L_0$ of the through hole is changed, and FIG. 21 shows the result in a case where the length $L_0$ of the through hole is set to 1 mm and the diameter Φ of the through hole is changed.

From FIG. 20, it can be seen that the correction coefficient magnifications are almost the same even in a case where the lengths $L_0$ of the through holes are different. As shown in FIG. 18, the resonance frequency changes depending on the length $L_0$ of the through hole. However, it is found that the correction coefficient magnification does not depend on the length $L_0$ of the through hole.

Further, it is understood from FIG. 21 that even in a case where the length $L_0$ of the through hole is a size that cannot be ignored, the correction coefficient magnification becomes larger as the diameter Φ of the through hole is larger.

<Simulation 4>

The size of the diameter Φ of the through hole is examined.

The resonance frequency is obtained by performing a simulation in which the diameter Φ of the through hole is set to 10 mm, the length $L_0$ of the through hole is set to 20 μm, the volume of the rear surface space is set to 2,120 $mm^3$, the rear surface distance is 0.5 mm, and the distance is changed from 1 mm to 10 mm at intervals of 1 mm.

Figure 22:
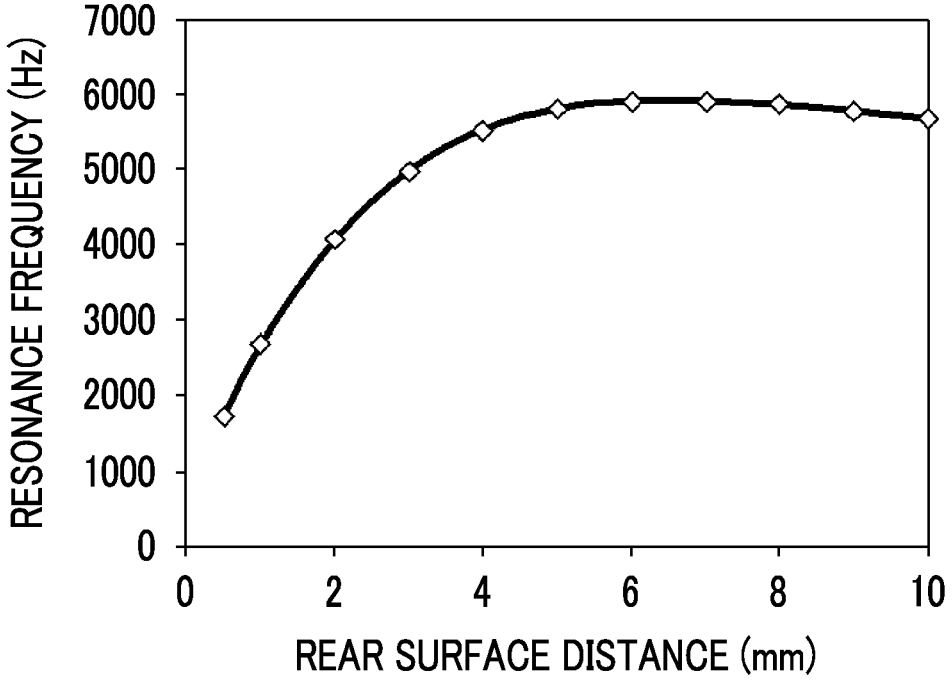
FIG. 22 is a graph showing a relationship between a rear surface distance and a resonance frequency.

The results thereof are shown in FIG. 22.

In addition, the resonance frequency is obtained by performing a simulation in which the diameter Φ of the through hole is set to 15 mm, the length $L_0$ of the through hole is set to 20 μm, the volume of the rear surface space is set to 4,770 $mm^3$, the rear surface distance is 0.5 mm, and the distance is changed from 1 mm to 10 mm at intervals of 1 mm.

Figure 23:
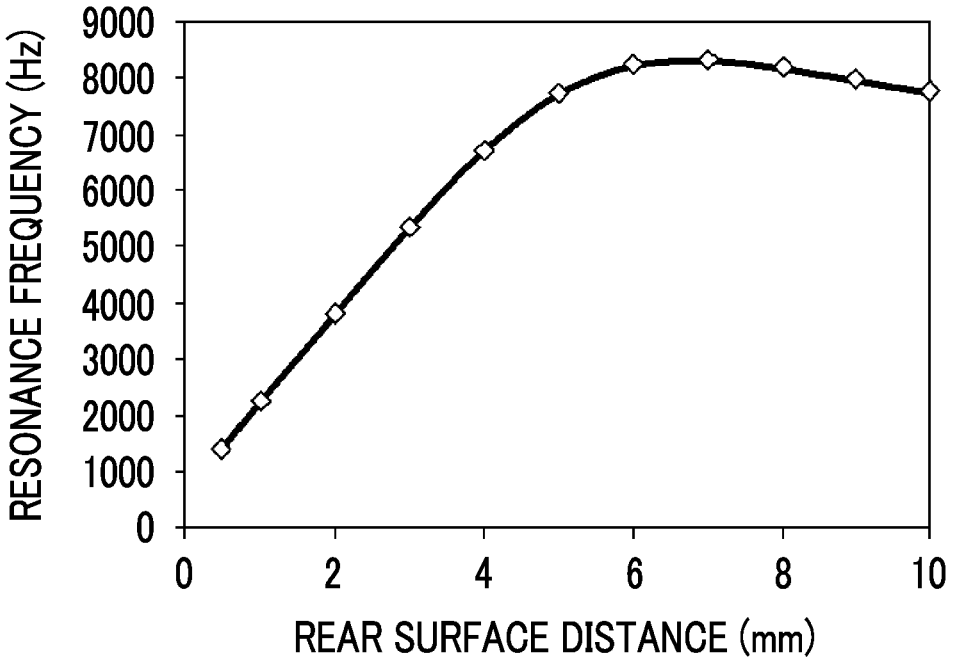
FIG. 23 is a graph showing a relationship between a rear surface distance and a resonance frequency.

The results thereof are shown in FIG. 23.

It should be noted that in a case where the diameter Φ of the through hole is large in this way, the diameter Φ of the through hole and the diameter of the rear surface space are close to each other, so that the conventional theory is not applicable. Therefore, the change in resonance frequency is considered.

From FIG. 22 and FIG. 23, it can be seen that in both cases, the resonance frequency shifts to a low frequency in the region where the rear surface distance d is small. On the other hand, with the point where the rear surface distance d is 6 mm as an apex, in a case where the rear surface distance d is larger than 6 mm, the frequency shifts slightly to a low frequency. Therefore, it is found that the effect of shortening the rear surface distance d and shifting the frequency at low frequency occurs in a case where the rear surface distance d is 6 mm or less.

As described above, from the result of the simulation 1 to 4, by setting the rear surface distance d to be equal to or less than the diameter Φ of the through hole and equal to or less than 6 mm, it is possible to obtain an effect that the opening end correction distance of the through hole becomes longer than the opening end correction distance in a normal case (a case of d>Φ. By utilizing this effect, the soundproof structure according to an aspect of the present invention can shift the resonance frequency to a low frequency even in a case where the volume of the rear surface space and the diameter of the through hole are the same. Therefore, the soundproof structure according to an aspect of the present invention can be made smaller and thinner in a case where soundproofing at the same frequency is performed.

The inventors of the present invention presume a mechanism in which the opening end correction distance of the through hole deviates from the conventional theory by making the rear surface distance d equal to or less than the diameter Φ of the through hole and equal to or less than 6 mm as follows.

In a case where the rear surface plate approaches the through hole to such an extent that the rear surface distance d is smaller than the diameter Φ of the through hole, it can be presumed that the rear surface space side is affected by the rear surface plate in the opening end correction regions formed in both the through holes. That is, since a local velocity of the sound is forcibly set to 0 at the position of the rear surface plate, a sound field around the through hole is determined accordingly. Since the local velocity becomes the maximum at a through hole portion, it can be assumed that the sound field is pushed out so as to extend to the side leading to the outside of the through hole in order to satisfy both a local velocity 0 of the rear surface plate and the increase in the local velocity of the through hole portion. In this case, since the region affected by the through hole is pushed out the outside of the Helmholtz resonator, the through hole behaves as if it were extended, and it can be presumed that the opening end correction distance is widened.

EXAMPLES

Hereinafter, the present invention will be described in more detail on the basis of Examples.

The materials, amounts used, ratios, processing details, processing procedures, and the like shown in the following Examples can be suitably changed without departing from the gist of the present invention. Therefore, the scope of the present invention should not be construed as being limited by the following Examples.

<Simulation 5>

First, a comparison between the simulation and the experiment is performed.

In the experiment, it is decided to use an acoustic tube having an inner diameter of 20 mm in order to measure the region up to a high frequency of 9 kHz. Therefore, a simulation is performed in a case where the diameter of the rear surface space is 20 mm.

A finite element method simulation is performed with the diameter Φ of the through hole changed from 2 mm to 6 mm at intervals of 1 mm, where the rear surface distance d is 1 mm and the lengths $L_0$ of the through holes are 2 mm, 3 mm, and 5 mm, respectively, to obtain the frequency at which the sound absorption coefficient is maximized.

Figure 24:
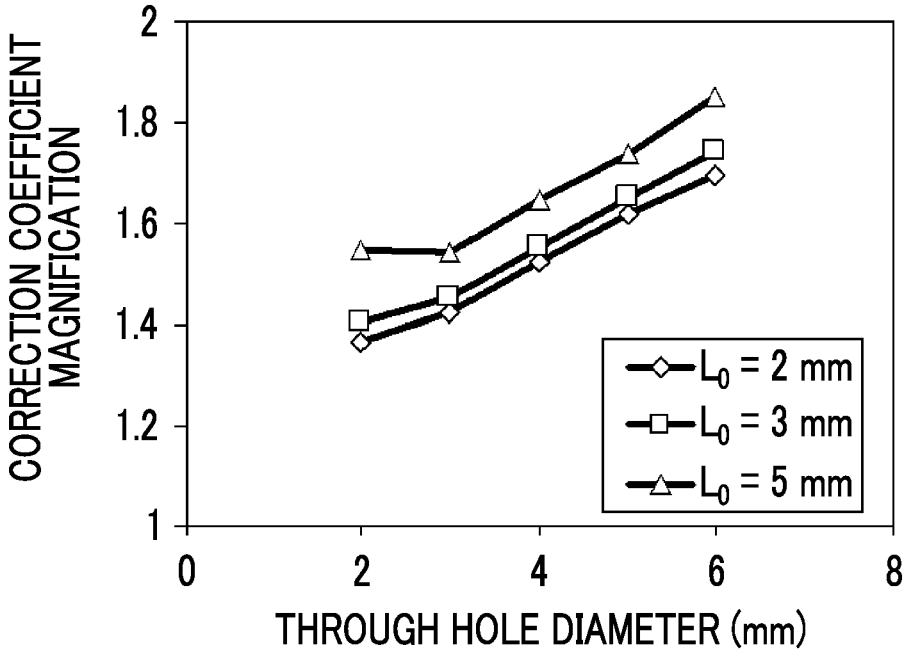
FIG. 24 is a graph showing a relationship between a through hole diameter and a correction coefficient magnification.

In the same manner as in other simulations, the magnification of the opening end correction coefficient to the opening end correction coefficient obtained from the conventional theory (correction coefficient magnification) is obtained. The results thereof are shown in FIG. 24. The correction coefficient magnification is in the range of 1.35 to 1.85, and it can be seen that the deviation from the conventional theory is sufficiently large. Therefore, the resonance frequency of the soundproof structure shifts to the low frequency side.

Example 1

A soundproof structure similar to that in simulation 5 is manufactured and measured.

An acrylic plate (Sumi Holiday manufactured by Hikari Co., Ltd.) having a thickness of 2 mm, 3 mm, and 5 mm is prepared. In addition, an acrylic plate with a thickness of 1 mm (manufactured by Sugawara Kogyo Co., Ltd.) is also prepared.

These acrylic plates are processed using a laser cutter.

First, the acrylic plate having a thickness of 2 mm, 3 mm, and 5 mm is used for the front surface side plate (hereinafter referred to as surface plate) on which the through holes are formed, and the outer diameter is set to 40 mm according to the outer diameter size of an acoustic tube, and a through hole is formed in the central portion thereof. The diameter of the through hole is from 1 mm to 6 mm at intervals of 1 mm. As a result, a total of 18 types of surface plates having a plate thickness of 3 types and a through hole diameter of 6 types are obtained.

Next, in order to form the rear surface space, 18 doughnut-shaped structures having an outer diameter of 40 mm and an inner diameter of 20 mm are manufactured from the acrylic plate having a thickness of 1 mm.

Further, as the rear surface plate, 18 acrylic plates having a thickness of 2 mm processed into a disk shape having the outer diameter of 40 mm are manufactured.

One doughnut-shaped acrylic plate having the thickness of 1 mm, the outer diameter of 40 mm, and the inner diameter of 20 mm is stacked under each surface plate, and another acrylic plate having the outer diameter of 40 mm serving as a rear surface plate is stacked under the doughnut-shaped acrylic plate, to thereby manufacture 18 types of soundproof structures having the rear surface space having the diameter of 20 mm and the thickness of 1 mm. Double-sided tape (Askul "power of the field") is used for overlapping the acrylic plates.

Each of the manufactured soundproof structures is disposed at the end portion of the acoustic tube having the inner diameter of 20 mm, and measurement is performed by a microphone two-terminal method. The reflectivity from the soundproof structure is measured, and the sound absorption coefficient is obtained from the 1-reflectivity.

Figure 25:
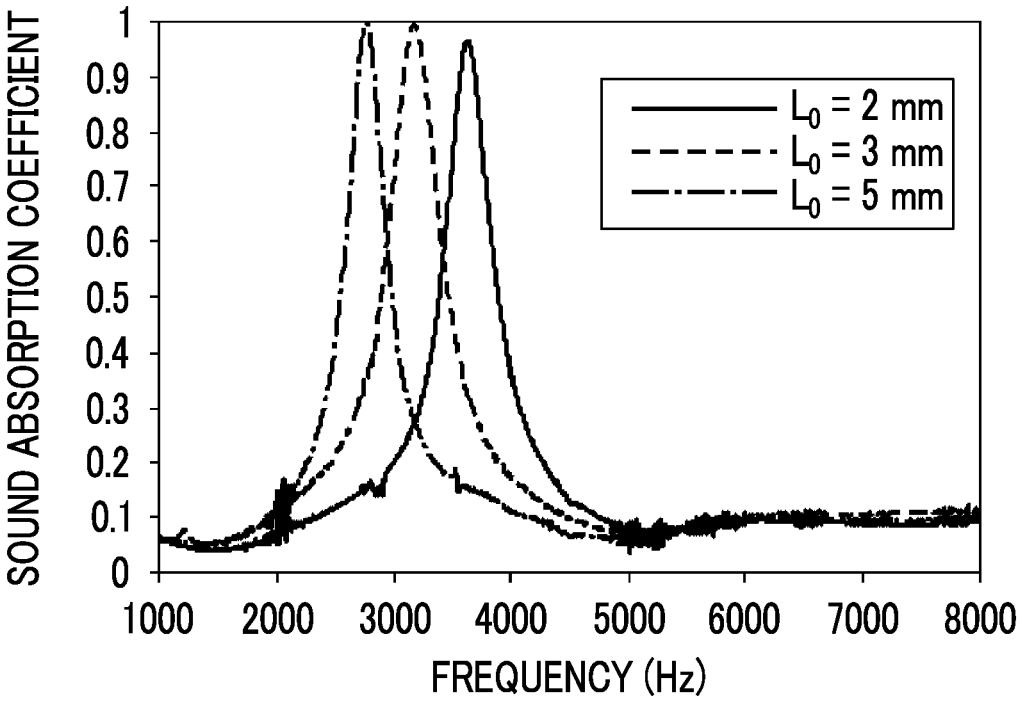
FIG. 25 is a graph showing a relationship between a frequency and a sound absorption coefficient.

As an example of the measurement result, in a case where the diameter Φ of the through hole is 3 mm and the length $L_0$ of the through hole is 2 mm, 3 mm, and 5 mm, respectively, the measurement results of the sound absorption coefficients are shown in FIG. 25.

From FIG. 25, it can be seen that the sound absorption peak shows a high sound absorption coefficient of almost 100%. It can also be seen that the longer the length $L_0$ of the through hole, the more the sound absorption peak is on the low frequency side.

For 18 types of soundproof structures, the maximum value of the sound absorption coefficient is obtained, and the frequency at that time is obtained and compared with the simulation. The case where the length $L_0$ of the through hole is 2 mm is shown in FIG. 26, the case where $L_0$ is 3 mm is shown in FIG. 27, and the case where $L_0$ is 5 mm is shown in FIG. 28.

Figure 26:
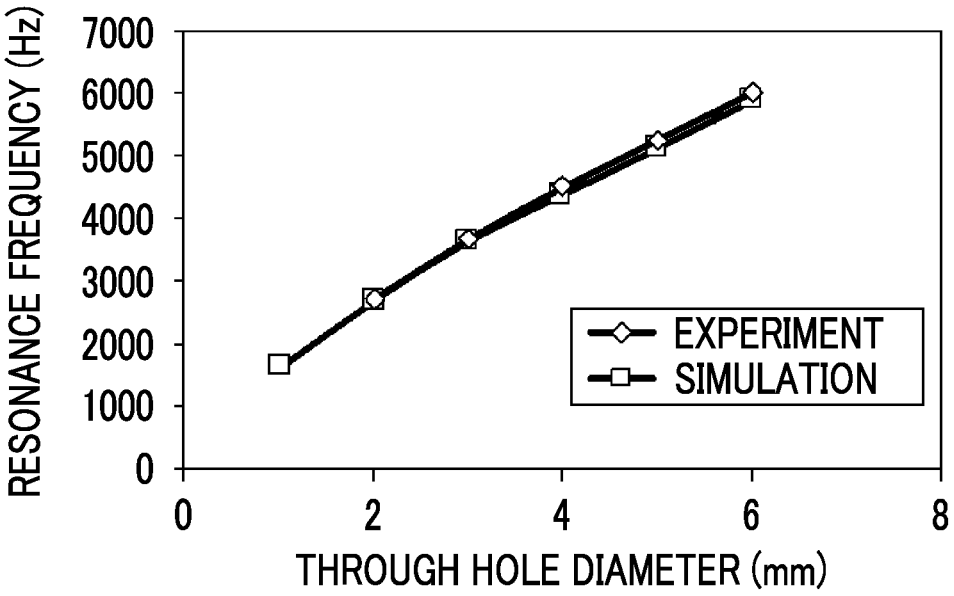
FIG. 26 is a graph showing a relationship between a through hole diameter and a resonance frequency.
Figure 27:
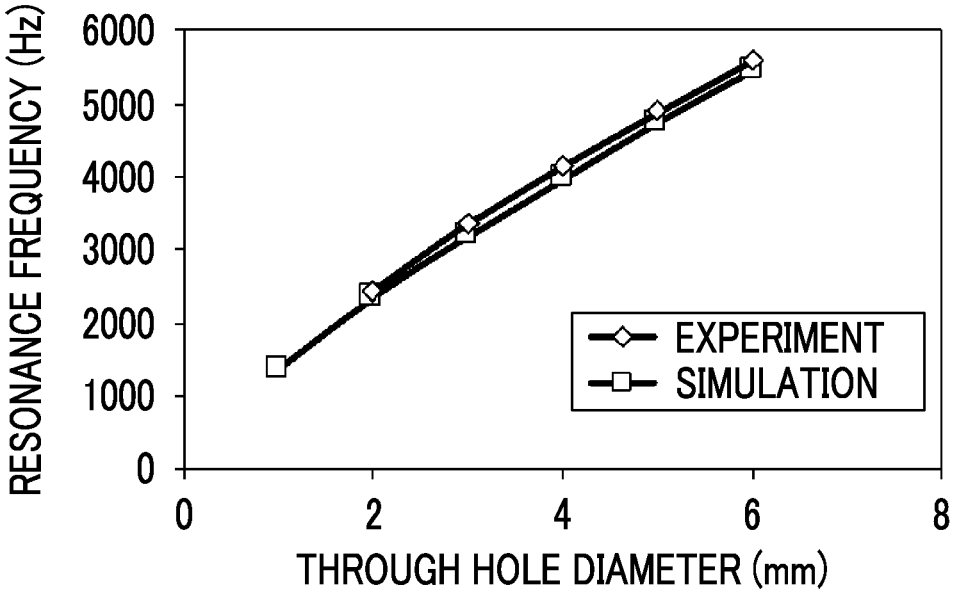
FIG. 27 is a graph showing a relationship between a through hole diameter and a resonance frequency.
Figure 28:
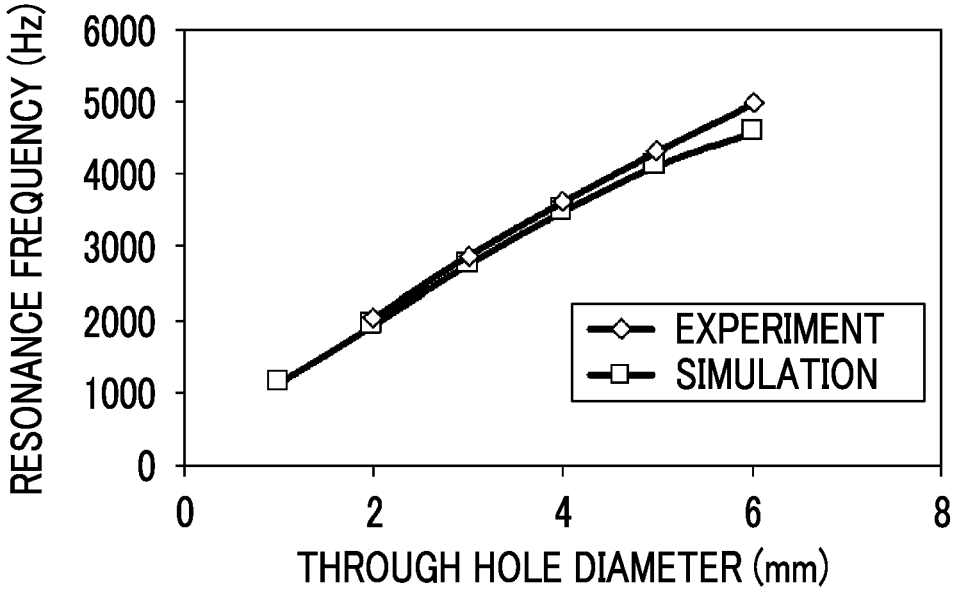
FIG. 28 is a graph showing a relationship between a through hole diameter and a resonance frequency.

From FIG. 26 to FIG. 28, it can be seen that the sound absorption peak frequency in the experiment, that is, the resonance frequency of each soundproof structure matches the resonance frequency in the simulation. That is, the experiment also show that the opening end correction distance deviates from the conventional theory and becomes a longer opening end correction distance by adopting the configuration of the present invention.

As described above, the effect of the present invention could be verified in the experiment.

<Simulation 6>

Next, as shown in FIG. 2, a configuration in which the rear surface plate is disposed in the rear surface space is examined using a simulation.

In the model, the height of the rear surface space is set to 8 mm, the diameter is set to 18.36 mm, and the volume of the rear surface space is set to 2,120 $mm^3$. In addition, the diameter Φ of the through hole is set to 10 mm, and the length $L_0$ is set to 20 μm. That is, the condition is that the effective length of the through hole is determined by the effect of opening end correction. In this configuration, the resonance frequency in a case where the rear surface plate is not inserted inside is 5,870 Hz.

A rear surface plate having a diameter of 15 mm and a thickness of 50 μm is disposed in the rear surface space so that the center axis of the rear surface plate is aligned with the center axis of the through hole.

Figure 29:
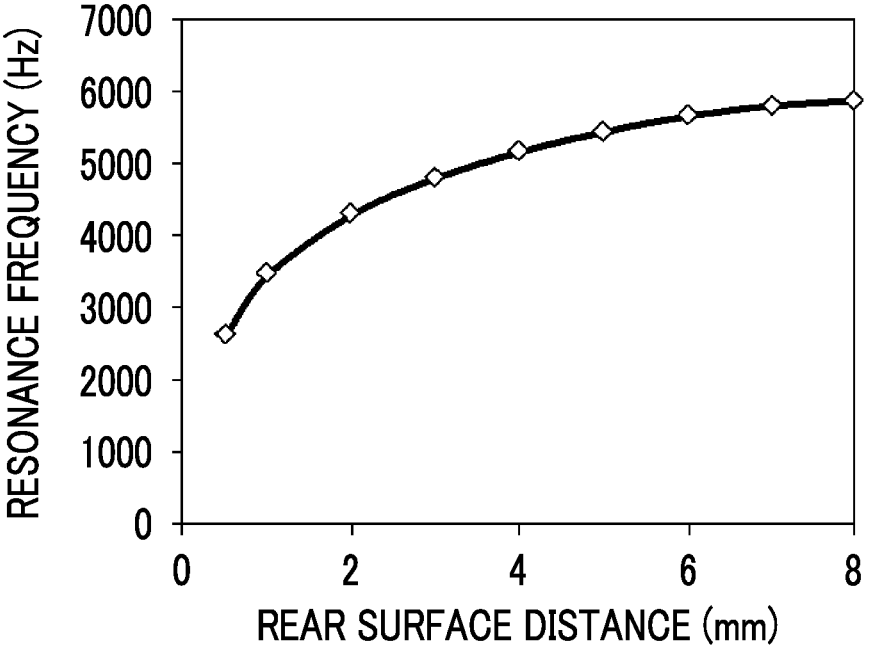
FIG. 29 is a graph showing a relationship between a rear surface distance and a resonance frequency.

The distance from the through hole (rear surface distance d) is changed from 0.5 mm to 1 mm to 7 mm at intervals of 1 mm, and the resonance frequencies at the each rear surface distance d are calculated. The results thereof are shown in FIG. 29. In FIG. 29, the rear surface distance of 8 mm indicates the resonance frequency in a case where the rear surface plate is not inserted.

From FIG. 29, it can be seen that the resonance frequency changes greatly by the rear surface distance d, even though a very thin rear surface plate is inserted into the rear surface space and there is almost no change in the volume of the rear surface space. It can be seen that the change is particularly large in a case where the rear surface distance d is small.

Since the volume of the rear surface space and the diameter of the through hole do not change, it is considered that the change in the resonance frequency is due to the change in the opening end correction distance. The opening end correction coefficient a is obtained from each resonance frequency, and the magnification (correction coefficient magnification) with respect to the opening end correction coefficient of the Helmholtz resonator in which the rear surface plate is not inserted is shown in FIG. 30.

Figure 30:
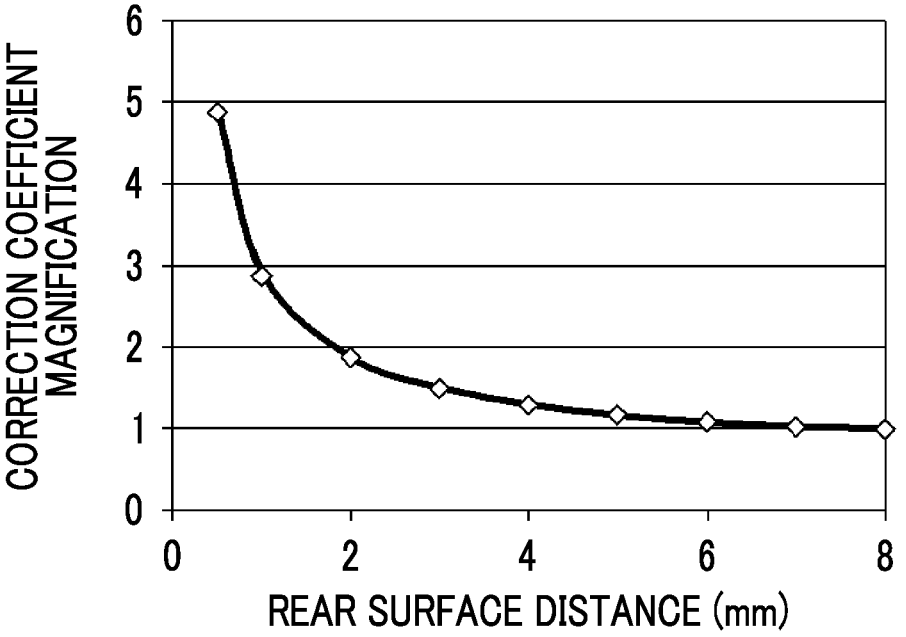
FIG. 30 is a graph showing a relationship between a rear surface distance and a correction coefficient magnification.

From FIG. 30, it can be seen that the rear surface distance d is 6 mm and the correction coefficient magnification is 1.07, and the rear surface distance d is 5 mm and the correction coefficient magnification is 1.16. Further, it can be seen that the correction coefficient magnification increases as the rear surface distance d becomes smaller.

<Simulation 7>

A simulation is performed in the same manner as in simulation 6 except that the diameter Φ of the through hole is set to 4 mm.

Figure 31:
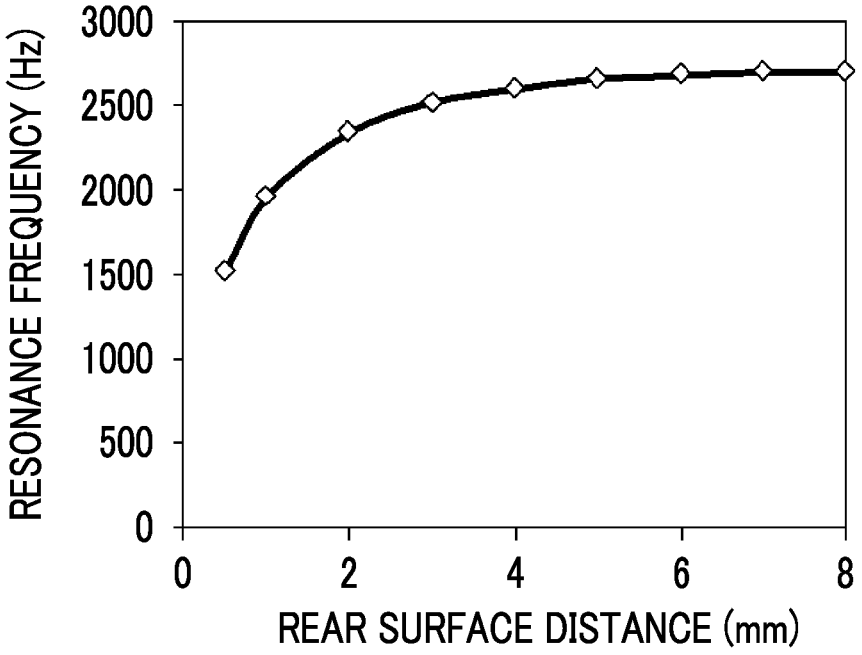
FIG. 31 is a graph showing a relationship between a rear surface distance and a resonance frequency.
Figure 32:
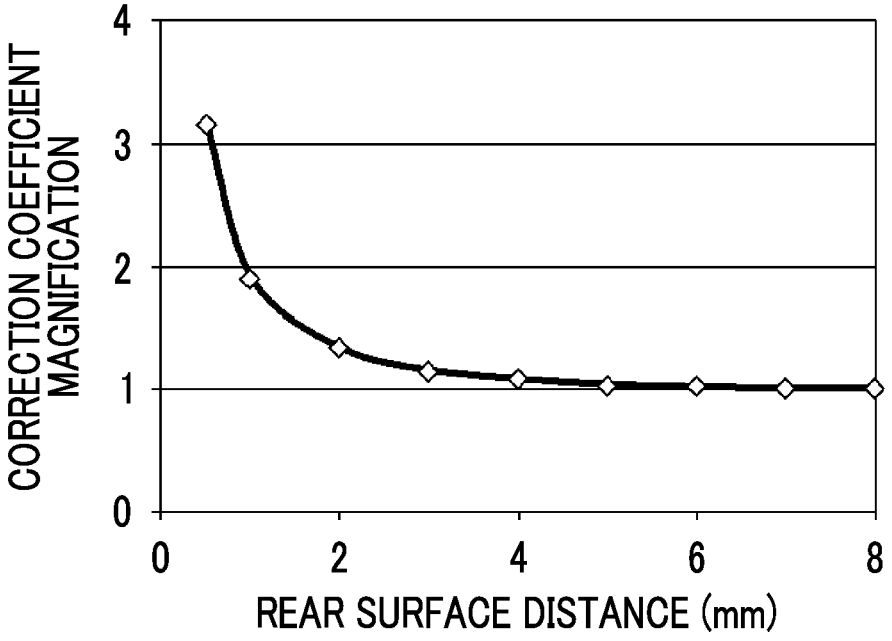
FIG. 32 is a graph showing a relationship between a rear surface distance and a correction coefficient magnification.

FIG. 31 shows a graph showing the relationship between the rear surface distance d and the resonance frequency, and FIG. 32 shows a graph showing the relationship between the rear surface distance d and the correction coefficient magnification.

From FIG. 31, it can be seen that the lower the rear surface distance d is, the lower the resonance frequency shifts. On the other hand, the amount of low frequency shift is small in the region where the rear surface distance d is larger than 4 mm. From FIG. 32, it can be seen that in a case where the rear surface distance d is 5 mm, the correction coefficient magnification is as small as 1.03 (is less than 1.05), and in a case where the rear surface distance d is 4 mm, the correction coefficient magnification is as large as 1.08 (is more than 1.05).

In comparison with the case of the simulation 6 (diameter Φ of the through hole is 10 mm), it is considered that the effect of increasing the opening end correction distance is smaller in the simulation 7 in a case where the diameter Φ of the through hole is 4 mm and the rear surface distance d is larger than 4 mm.

<Simulation 8>

A simulation is performed in the same manner as in simulation 7 except that the diameter of the rear surface space is 12.24 mm and the volume of the rear surface space is 942 $mm^3$. In this configuration, the resonance frequency in a case where the rear surface plate is not inserted inside is 4,080 Hz.

Figure 33:
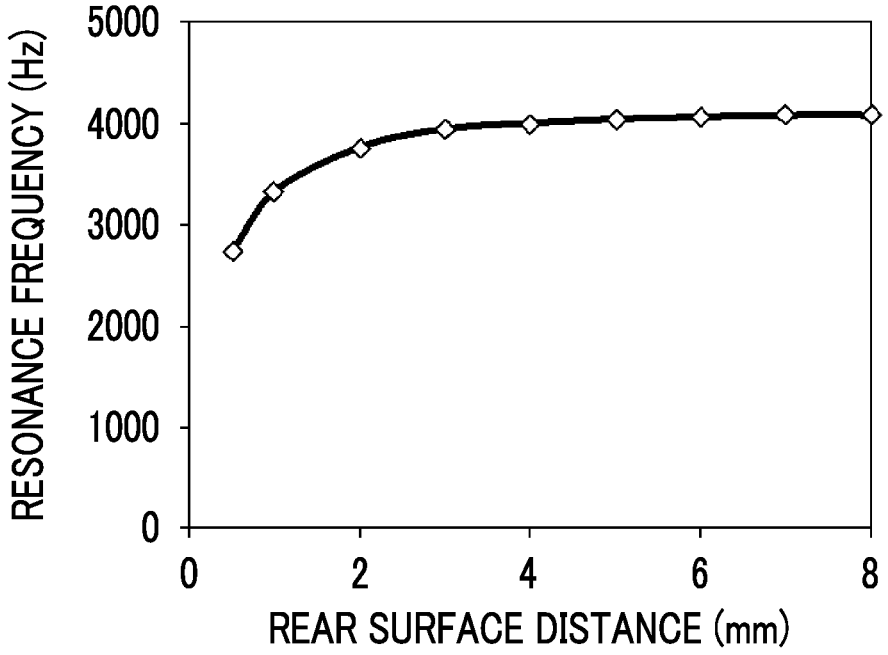
FIG. 33 is a graph showing a relationship between a rear surface distance and a resonance frequency.
Figure 34:
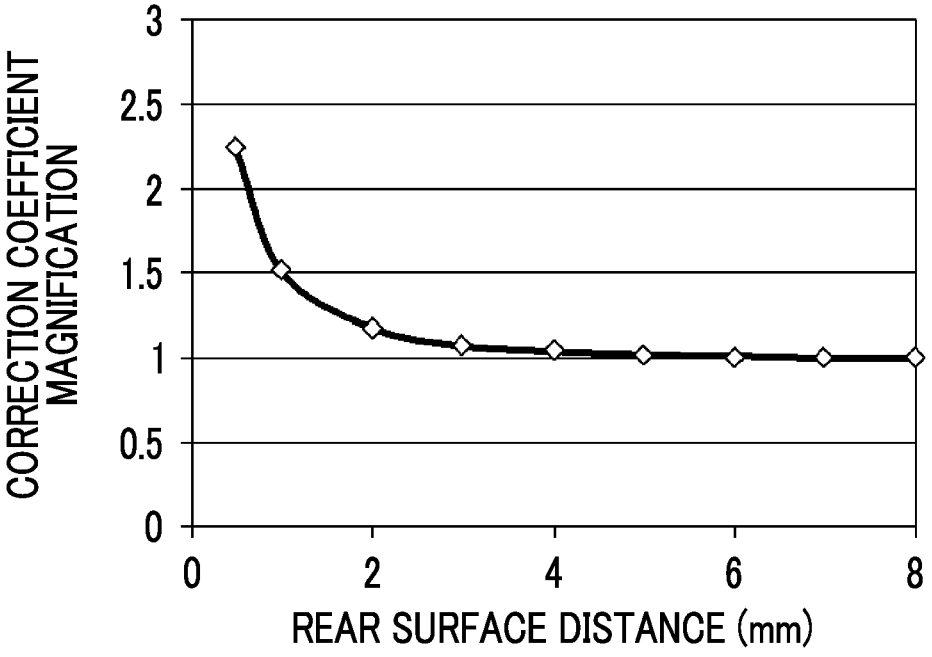
FIG. 34 is a graph showing a relationship between a rear surface distance and a correction coefficient magnification.

FIG. 33 shows a graph showing the relationship between the rear surface distance d and the resonance frequency, and FIG. 34 shows a graph showing the relationship between the rear surface distance d and the correction coefficient magnification.

From FIG. 33, it can be seen that the lower the rear surface distance d is, the lower the resonance frequency shifts. In addition, it can be seen that the amount of low frequency shift increases in a case where the rear surface distance d is 4 mm or less. Further, from FIG. 34, it can be seen that the smaller the rear surface distance d, the higher the correction coefficient magnification, and in a case where the rear surface distance d is 4 mm or less, the correction coefficient magnification becomes significantly higher.

From the results of the simulation 6 to 8, it can be seen that even in the configuration in which the rear surface plate is disposed in the rear surface space, in a case where the rear surface distance d is equal to or less than the diameter Φ of the through hole and equal to or less than 6 mm, the opening end correction distance of the through hole becomes longer than the opening end correction distance in the normal case (in a case of d>Φ, and the resonance frequency can be shifted at a low frequency.

<Simulation 9>

Next, in the case of the configuration in which the rear surface plate is disposed in the rear surface space, the disposition position of the rear surface plate was examined.

Figure 35:
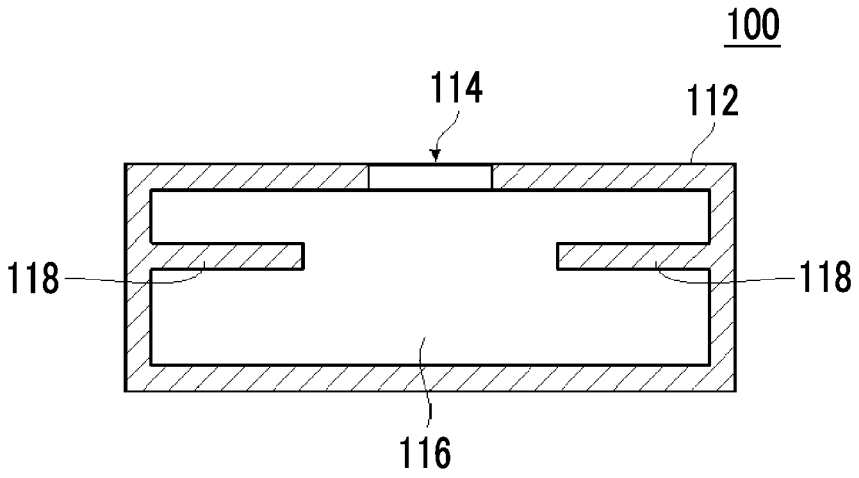
FIG. 35 is a cross-sectional view schematically showing a soundproof structure of a comparative example.

Specifically, as in the soundproof structure 100 shown in FIG. 35, a simulation is performed on a configuration in which a rear surface plate 118 is disposed at a position that does not overlap with the through hole as viewed from a through hole 114 in the penetrating direction. The configuration is the same as in simulation 7 except that the position of the rear surface plate 118 is different. The rear surface plate 118 has a length of 5 mm from a housing 112.

Figure 36:
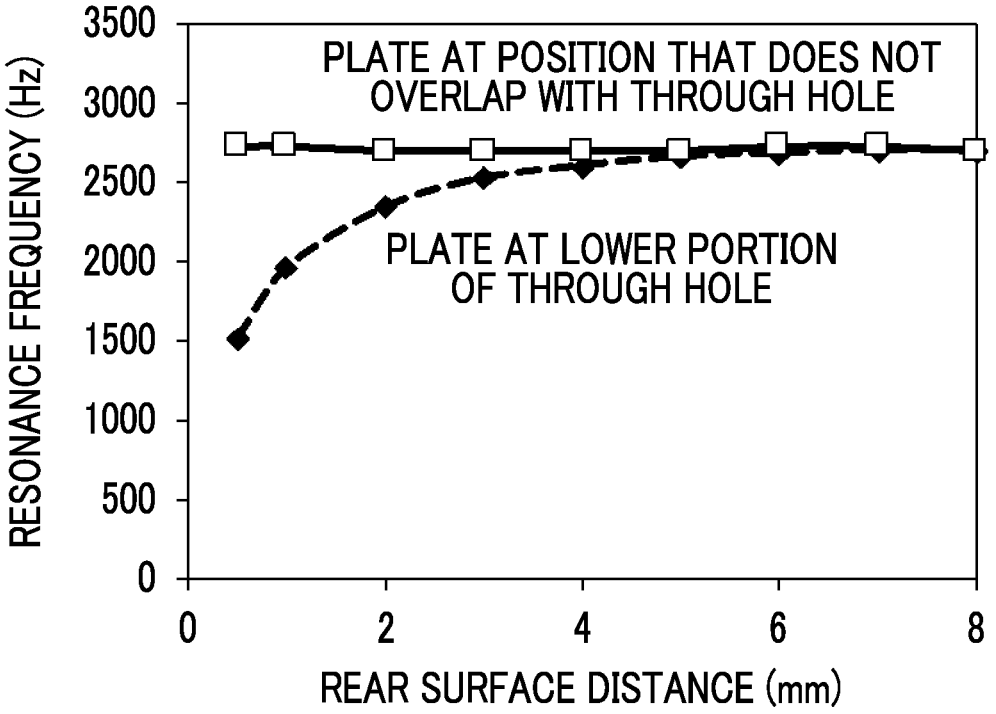
FIG. 36 is a graph showing a relationship between a rear surface distance and a resonance frequency.

In such a configuration, the position of the rear surface plate 118 of the through hole in the penetrating direction is changed and the same simulation is performed to obtain the resonance frequency. The results thereof are shown in FIG. 36. FIG. 36 also shows the results of simulation 7.

From FIG. 36, it can be seen that in a case where the rear surface plate is disposed at a position that does not overlap with the through hole as viewed from a penetrating direction of the through hole, the resonance frequency hardly shifts. Therefore, it can be seen that not only the rear surface plate is located inside the rear surface space, but also that the rear surface plate is located at a position overlapping the through hole is important for the low frequency shift.

<Simulation 10>

A structure in which an annular-shaped through hole having a cross-sectional shape as shown in FIG. 5 is formed in the housing is examined.

In the model, the height of the rear surface space is set to 8 mm, the diameter is set to 18.36 mm, and the volume of the rear surface space is set to 2,120 $mm^3$. In addition, the through hole is set to an annular shape with an outer diameter of 18.36 mm and an inner diameter of 17.36 mm. That is, a slit-shaped through hole having a width of 0.5 mm is formed along the inner circumference of the rear surface space. The length $L_0$ of the through hole is set to 20 μm. The equivalent circle diameter is obtained from the area of the through hole to be 6 mm. The resonance frequency of this configuration in a case where the rear surface plate is not inserted is 5,420 Hz.

The rear surface plate having a thickness of 50 μm is disposed at a position overlapping the through hole inside the rear surface space. The rear surface plate is set to an annular shape with an outer diameter of 18.36 mm and an inner diameter of 8.36 mm. That is, the rear surface plate has a shape extending 5 mm from the housing into the rear surface space.

The distance between the rear surface plate and the through hole, that is, the rear surface distance d is changed from 0.5 mm to 1 mm to 7 mm at intervals of 1 mm, and the resonance frequencies at the each rear surface distance d are calculated. In addition, the correction coefficient magnification is obtained from the resonance frequency. The results are shown in FIG. 37 and FIG. 38.

In a case where the opening shape of the through hole is non-circular as in the model of simulation 10, it is difficult to apply the theoretical formula of the opening end correction as it is. However, in simulation 10, since the length $L_0$ of the through hole is sufficiently small, there is no difference that the effective length of the through hole is formed by the opening end correction. In addition, the shape and area of the through hole are not changed before and after inserting the rear surface plate. Therefore, the ratio of the change in the effective length of the through hole in a case where the rear surface plate is inserted can be obtained with respect to the case where the rear surface plate is not provided, and the correction coefficient magnification can be obtained from it.

Figure 37:
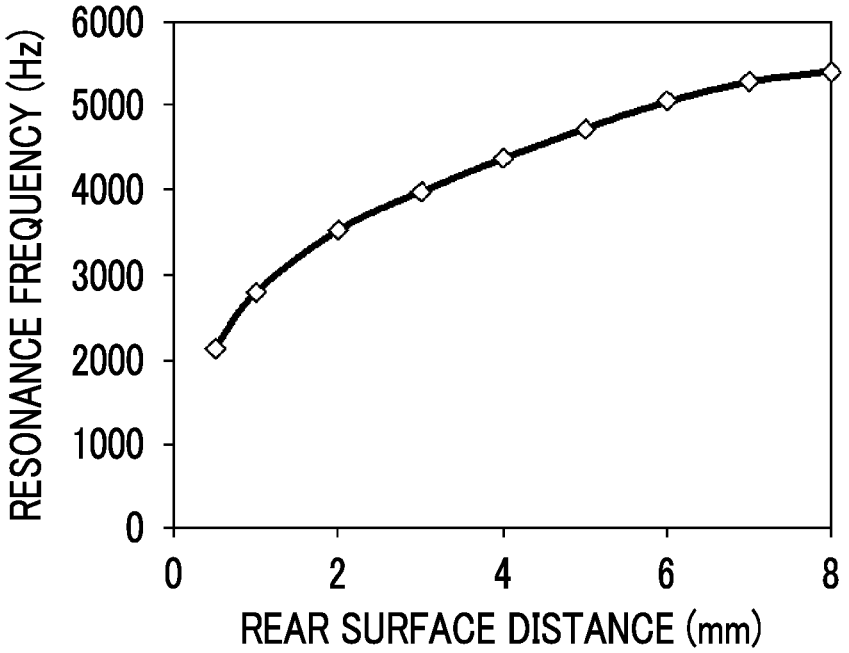
FIG. 37 is a graph showing a relationship between a rear surface distance and a resonance frequency.
Figure 38:
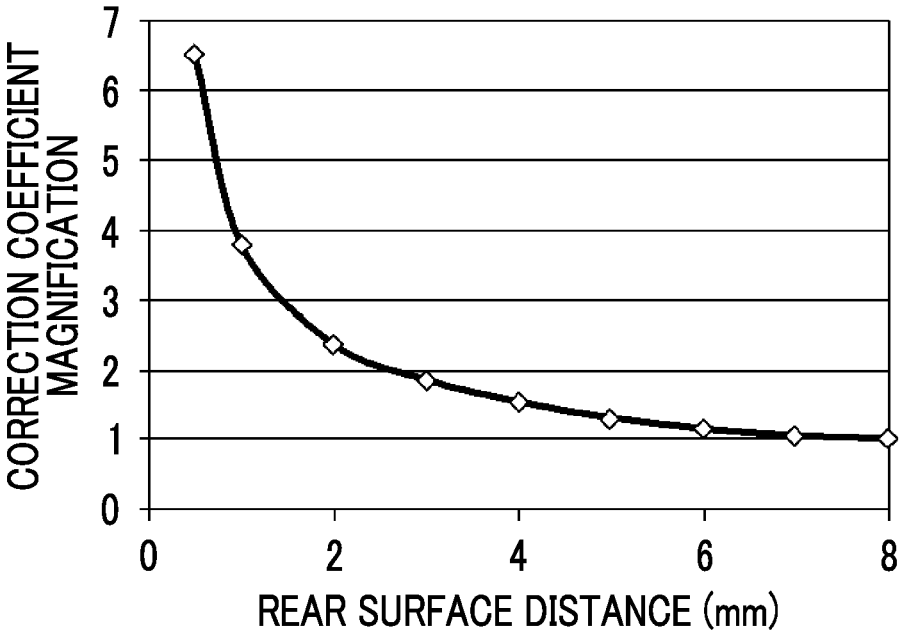
FIG. 38 is a graph showing a relationship between a rear surface distance and a correction coefficient magnification.

From FIG. 37, it can be seen that even in a case where the opening shape of the through hole is not circular, the low frequency shift is greatly performed by inserting the rear surface plate into the lower portion of the through hole. In a case where, from FIG. 38, it can be seen that the amount of change in the opening end correction distance is also large.

<Simulation 11>

Figure 39:
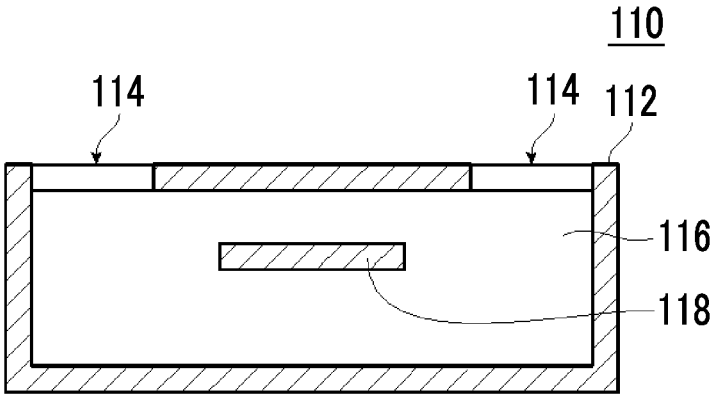
FIG. 39 is a cross-sectional view schematically showing a soundproof structure of a comparative example.
Figure 40:
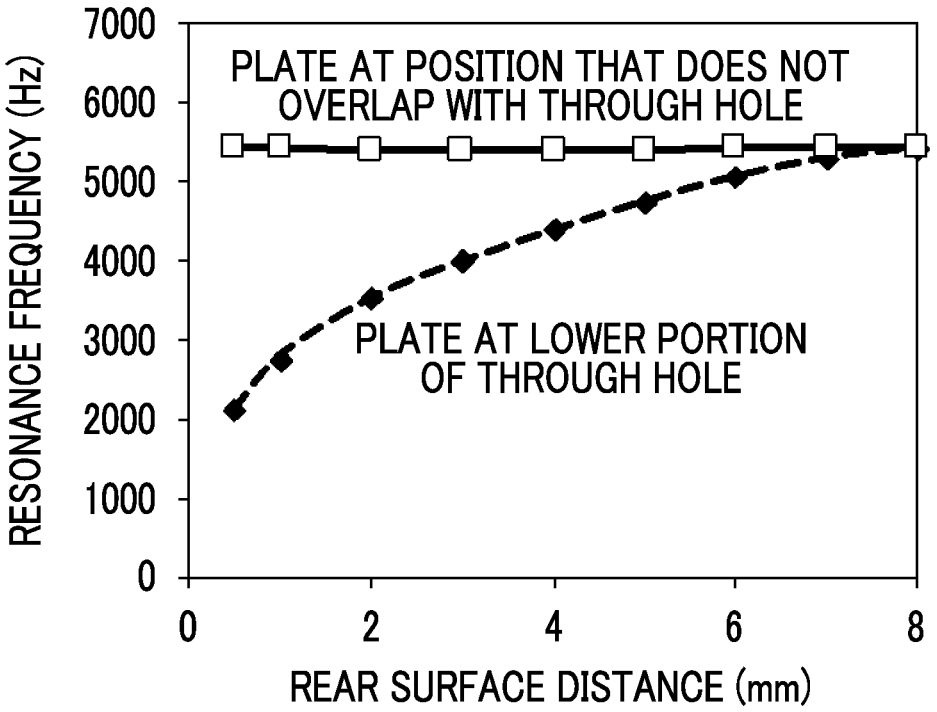
FIG. 40 is a graph showing a relationship between a rear surface distance and a resonance frequency.

For comparison, a simulation is performed in the same manner as in the simulation 10 except that the rear surface plate 118 is disposed at a position that does not overlap with the through hole 114, that is, at the center position as in a soundproof structure 110 shown in FIG. 39. The diameter of the rear surface plate 118 is set to 10 mm. The results thereof are shown in FIG. 40. FIG. 40 also shows the results of simulation 10.

From FIG. 40, it can be seen that even in a case where the opening shape of the through hole is non-circular, assuming that the rear surface plate is disposed at a position that does not overlap with the through hole as viewed from a penetrating direction of the through hole, the resonance frequency hardly shifts.

From the results of the above simulation, it can be seen that the shape and position of the through hole are circular and not limited to the central portion, and a random through hole shape may be formed at a random position. In addition, the condition of the disposition position of the rear surface plate is that the rear surface plate is disposed at a position overlapping the through hole as viewed from the penetrating direction of the through hole, which is a requirement of the low frequency shift, and it can be seen that the low frequency shift hardly occurs in a case where the through hole and the rear surface plate do not overlap as viewed from the penetrating direction.

From the above results, it is clear that the effect of the present invention is obtained.

EXPLANATION OF REFERENCES

10, 10*a* to 10*n*: soundproof structure
12: housing
14, 14*a* to 14*c*: through hole
16, 16*a* to 16*b*: rear surface space
18: rear surface plate
24: porous sound absorbing body
50, 50*a* to 50*b*: soundproof unit

What is claimed is:

1. A soundproof structure that includes a housing forming a space therein and having a through hole that allows the space to communicate with an outside, and generates Helmholtz resonance by the space and the through hole, the soundproof structure comprising:

a rear surface plate disposed at a position overlapping the through hole on the space side as viewed from a penetrating direction of the through hole, wherein a diameter of the through hole is Φ and a distance from the rear surface plate to an opening surface of the through hole on the space side is d, d≤Φ is satisfied and d≤ 6 mm is satisfied, a coefficient of an opening end correction in the through hole is 1.8 or more, and the rear surface plate is disposed in the space.

2. The soundproof structure according to claim 1, wherein a part of the housing functions as the rear surface plate.

3. The soundproof structure according to claim 1, wherein the rear surface plate is movable in the penetrating direction of the through hole.

4. The soundproof structure according to claim 1, wherein the through hole has a diameter Φ of 1 mm or more.

5. The soundproof structure according to claim 1, wherein at least a part of the housing is formed of a hollow material or a foamed material.

6. The soundproof structure according to claim 1, wherein an average thickness of the entire soundproof structure is 10 mm or less.

7. The soundproof structure according to claim 1, further comprising:

a porous sound absorbing body attached to at least a part of the soundproof structure.

8. A soundproof unit comprising:

a plurality of the soundproof structures according to claim 1.

9. The soundproof unit according to claim 8, wherein the soundproof unit has two or more soundproof structures having different resonance frequencies.

10. The soundproof unit according to claim 8, wherein in the two or more soundproof structures having different resonance frequencies, the through holes have the same diameter and the spaces have different volumes.

11. The soundproof unit according to claim 8, wherein in the two or more soundproof structures having different resonance frequencies, the housings have the same shape and the through holes have different diameters.

12. The soundproof structure according to claim 2, wherein the through hole has a diameter Φ of 1 mm or more.

13. The soundproof structure according to claim 2, wherein at least a part of the housing is formed of a hollow material or a foamed material.

14. The soundproof structure according to claim 2, wherein an average thickness of the entire soundproof structure is 10 mm or less.

15. The soundproof structure according to claim 2, further comprising:

a porous sound absorbing body attached to at least a part of the soundproof structure.

16. A soundproof unit comprising:

a plurality of the soundproof structures according to claim 2.

17. The soundproof unit according to claim 16, wherein the soundproof unit has two or more soundproof structures having different resonance frequencies.

18. The soundproof unit according to claim 16, wherein in the two or more soundproof structures having different resonance frequencies, the through holes have the same diameter and the spaces have different volumes.

19. The soundproof unit according to claim 16, wherein in the two or more soundproof structures having different resonance frequencies, the housings have the same shape and the through holes have different diameters.

* * * * *